US010893733B2

(12) United States Patent
Kao et al.

(10) Patent No.: US 10,893,733 B2
(45) **Date of Patent: *Jan. 19, 2021**

(54) ACCESSORY ORGANIZER FOR USE WITH A LUGGAGE BAG

(71) Applicant: OREGAMI, LLC, Fairview, OR (US)

(72) Inventors: David Kao, Portland, OR (US); Richard P. Christen, Bend, OR (US)

(73) Assignee: OREGAMI, LLC, Gresham, OR (US)

( * ) Notice: Subject to any disclaimer, the term of this patent is extended or adjusted under 35 U.S.C. 154(b) by 256 days.

This patent is subject to a terminal disclaimer.

(21) Appl. No.: 16/000,851

(22) Filed: Jun. 5, 2018

(65) Prior Publication Data

US 2018/0279734 A1 Oct. 4, 2018

Related U.S. Application Data

(63) Continuation-in-part of application No. 14/941,950, filed on Nov. 16, 2015, now Pat. No. 10,123,599, (Continued)

(51) Int. Cl.
*A45C 13/02* (2006.01)
*A45C 7/00* (2006.01)
(Continued)

(52) U.S. Cl.
CPC ..... *A45C 13/02* (2013.01); *A45C 3/004* (2013.01); *A45C 5/03* (2013.01); *A45C 5/14* (2013.01); *A45C 7/005* (2013.01); *A45C 7/0054* (2013.01); *A45C 13/03* (2013.01); *A45C 2003/002* (2013.01); *A45C 2011/002* (2013.01); *A45C 2011/003* (2013.01); *A45C 2013/026* (2013.01)

(58) Field of Classification Search
CPC . A45C 2013/026; A45C 7/0095; A45C 13/02; A45C 7/0036; A45C 7/0045
USPC ..... 190/107–109
See application file for complete search history.

(56) References Cited

U.S. PATENT DOCUMENTS 2,082,011 A 6/1937 Lee
3,120,297 A * 2/1964 Riley ..... A45C 7/0095 190/110

(Continued)

*Primary Examiner* — Sue A Weaver
(74) *Attorney, Agent, or Firm* — Renaissance IP Law Group, LLP; David A. Crowther

(57) ABSTRACT

Embodiments of the invention provide a module collapsible accessory organizer for use with a luggage bag. The accessory organizer includes foldable compartments. The compartments can each be collapsed down when necessary to free up interior volume of the luggage bag in which the accessory organizer is placed. The compartments can stack and fold onto each other, and be inserted into or removed from a luggage bag. The compartments can be attached to each other. The compartments are modular such that the accessory organizer can be configured to include any desired number of compartments. The compartments of the accessory organizer are quickly unfolded and deployed for easy access to personal contents stored therein. The accessory organizer is a standalone organizer when not stored in a luggage bag. The accessory organizer can be manufactured and shipped as a standalone organizer, and then used with a variety of already-existent luggage bags of various dimensions.

20 Claims, 31 Drawing Sheets

Related U.S. Application Data which is a continuation-in-part of application No. 14/293,588, filed on Jun. 2, 2014, now Pat. No. 9,215,918.

(60) Provisional application No. 61/833,270, filed on Jun. 10, 2013.

(51) Int. Cl.

| | |
|---|---|
| ***A45C 5/03*** | (2006.01) |
| ***A45C 3/00*** | (2006.01) |
| ***A45C 13/03*** | (2006.01) |
| ***A45C 5/14*** | (2006.01) |
| *A45C 11/00* | (2006.01) |

(56) References Cited

U.S. PATENT DOCUMENTS

| | | | | |
|---|---|---|---|---|
| 3,530,961 | A | 9/1970 | Weissenbach | |
| 4,210,186 | A * | 7/1980 | Belenson | A45C 3/00 190/110 |
| 4,598,802 | A * | 7/1986 | Abenaim | A45C 7/0036 190/107 |
| 4,718,524 | A | 1/1988 | Crumley | |
| 4,887,751 | A | 12/1989 | Lehman | |
| 5,096,030 | A | 3/1992 | Espinosa et al. | |
| 5,105,919 | A * | 4/1992 | Bomes | A45C 3/00 150/117 |
| 5,240,106 | A | 8/1993 | Plath | |
| 5,624,026 | A | 4/1997 | Chernoff | |
| 5,749,446 | A * | 5/1998 | Hsieh | A45C 7/0022 190/103 |
| 6,168,022 | B1 | 1/2001 | Ward et al. | |
| 6,523,653 | B2 | 2/2003 | Roegner | |
| 8,800,737 | B2 * | 8/2014 | Fair | A45C 13/02 150/112 |
| 9,215,918 | B2 * | 12/2015 | Kao | A45C 3/004 |
| 2004/0108179 | A1 * | 6/2004 | Scicluna | A45C 7/0054 190/109 |
| 2004/0173427 | A1 | 9/2004 | Chernoff | |
| 2007/0044877 | A1 | 3/2007 | Davidoff et al. | |
| 2009/0288925 | A1 * | 11/2009 | Hess | A45C 13/02 190/107 |
| 2013/0233741 | A1 * | 9/2013 | Caruth | A45C 5/005 206/232 |

* cited by examiner

ACCESSORY ORGANIZER FOR USE WITH A LUGGAGE BAG

RELATED APPLICATION DATA

This application is a continuation in part of commonly-assigned U.S. patent application Ser. No. 14/941,950, filed Nov. 16, 2015, which is a continuation in part of commonly-assigned U.S. patent application Ser. No. 14/293,588, filed Jun. 2, 2014, which claims the benefit of commonly-assigned U.S. Provisional Pat. Application Ser. No. 61/833,270, filed Jun. 10, 2013, which are hereby incorporated by reference in their entirety.

FIELD OF THE INVENTION

This application pertains to luggage, and more particularly, to a luggage bag having an organizer containable therein.

BACKGROUND

Millions of travelers go from one place to another every day around the world. The travelers usually must carry their personal belongings in some kind of bag or container, especially if the trip lasts for more than one day. Various types of luggage, baggage, and related containers have been proposed for transporting items safely and securely from one destination to another. However, conventional luggage and bags are often bulky and awkward, and fail to provide the ability to efficiently fit, organize, view, and access a person's belongings. Some travelers with larger items need an easier way to manipulate the shape, size, and configuration of containers within the luggage bag, but conventional luggage bags lack such configurability. Another problem with conventional luggage bags is the overall weight of the luggage bag since this can cause additional surcharges by airlines. Conventional luggage bags also fail to provide the configurability, organizational, and accessibility features necessary to improve on the travel experience.

Accordingly, a need remains for a modular collapsible accessory organizer for use with a luggage bag, which accommodates and organizes multiple types of personal belongings including garments and other belongings, and which provides quick and easy visibility and access to its contents. Embodiments of the invention address these and other limitations in the prior art.

The foregoing and other features of the invention will become more readily apparent from the following detailed description, which proceeds with reference to the accompanying drawings.

DETAILED DESCRIPTION OF THE EMBODIMENTS

Reference will now be made in detail to embodiments of the inventive concept, examples of which are illustrated in the accompanying drawings. The accompanying drawings are not necessarily drawn to scale. In the following detailed description, numerous specific details are set forth to enable a thorough understanding of the inventive concept. It should be understood, however, that persons having ordinary skill in the art may practice the inventive concept without these specific details. In other instances, well-known methods, procedures, and components, have not been described in detail so as not to unnecessarily obscure aspects of the embodiments.

It will be understood that, although the terms first, second, etc. may be used herein to describe various elements, these elements should not be limited by these terms. These terms are only used to distinguish one element from another. For example, a first handle could be termed a second handle, and, similarly, a second handle could be termed a first handle, without departing from the scope of the inventive concept.

It will be understood that when an element or layer is referred to as being "on," "coupled to" or "connected to" another element or layer, it can be directly on, directly coupled to or directly connected to the other element or layer, or intervening elements or layers may be present. In contrast, when an element is referred to as being "directly on," "directly coupled to" or "directly connected to" another element or layer, there are no intervening elements or layers present. Like numbers refer to like elements throughout. As used herein, the term "and/or" includes any and all combinations of one or more of the associated listed items.

The terminology used in the description of the inventive concept herein is for the purpose of describing particular embodiments only and is not intended to be limiting of the inventive concept. As used in the description of the inventive concept and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Figure 1:
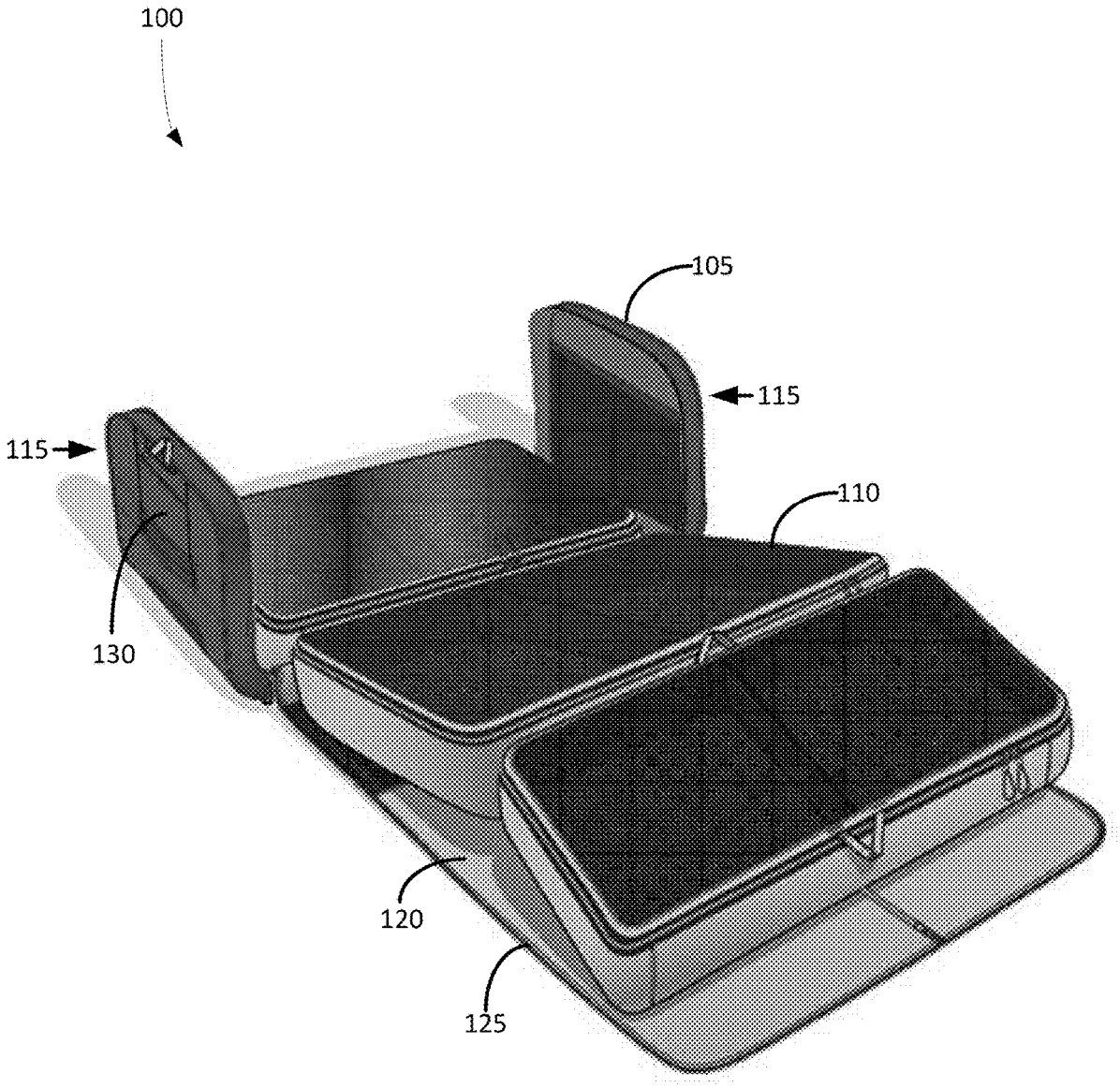
FIG. 1 illustrates a luggage bag including an outer container in an opened configuration and a removable organizer in accordance with various inventive concepts of the present invention.
Figure 2:
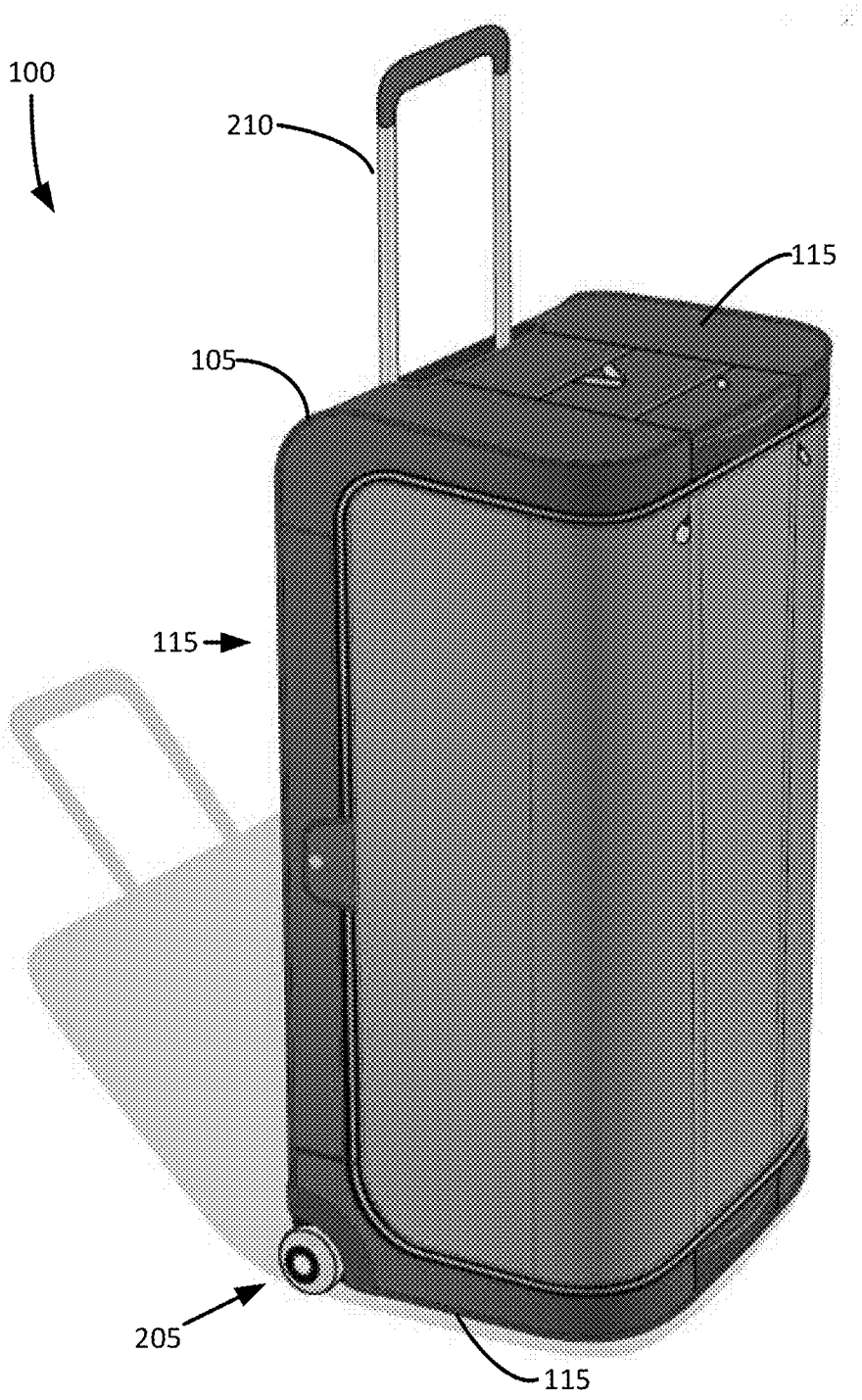
FIG. 2 illustrates the luggage bag of FIG. 1 in a closed configuration.

FIG. 1 illustrates a luggage bag 100 including an outer container 105 in an opened configuration and a removable organizer 110 in accordance with various inventive concepts of the present invention. FIG. 2 illustrates the luggage bag 100 of FIG. 1 in a closed configuration. Reference is now made to FIGS. 1 and 2.

The luggage bag 100 generally includes an outer container 105 and a removable organizer 110, which can be contained within the outer container 105. As will be discussed, the organizer 110 allows items to be stored securely and conveniently within the container 105. Also, the organizer 110 fits neatly into the container 105. Moreover, the organizer 110 can be modular and configurable for additional benefits, which are discussed in detail below.

The outer container 105 can be of any suitable type. For example, the container 105 can have rigid walls (e.g., 115) so that it essentially maintains its shape whether in the opened configuration as shown in FIG. 1 or the closed configuration as shown in FIG. 2. Alternatively, the container 105 can have flexible or collapsible walls (e.g., 115). The container 105 can also include a closure flap 120, which can include connective means such as a zipper 125 that allows the closure flap 120 to be selectively connected or disconnected from the walls 115, thereby placing the luggage bag 100 into either the closed configuration or the open configuration, respectively. The luggage bag 100 can include an external-access storage area 130, which can store a smart phone, airline ticket information, and the like.

The outer container 105 can also include other features that enhance portability. For example, the container 105 can include one or more wheels 205, which can be attached at the joining region of two or more walls 115, as shown in FIG. 2. The container 105 can also include a telescoping handle 210 (FIG. 2). It will be appreciated, that the container 105 can vary in many ways from the container 105 shown in the Figures. Indeed, the container 105 can be of any suitable type, can have any suitable shape, and can incorporate one or more additional features typically found on other bags, luggage, briefcases, handbags, purses, and the like.

Figure 3:
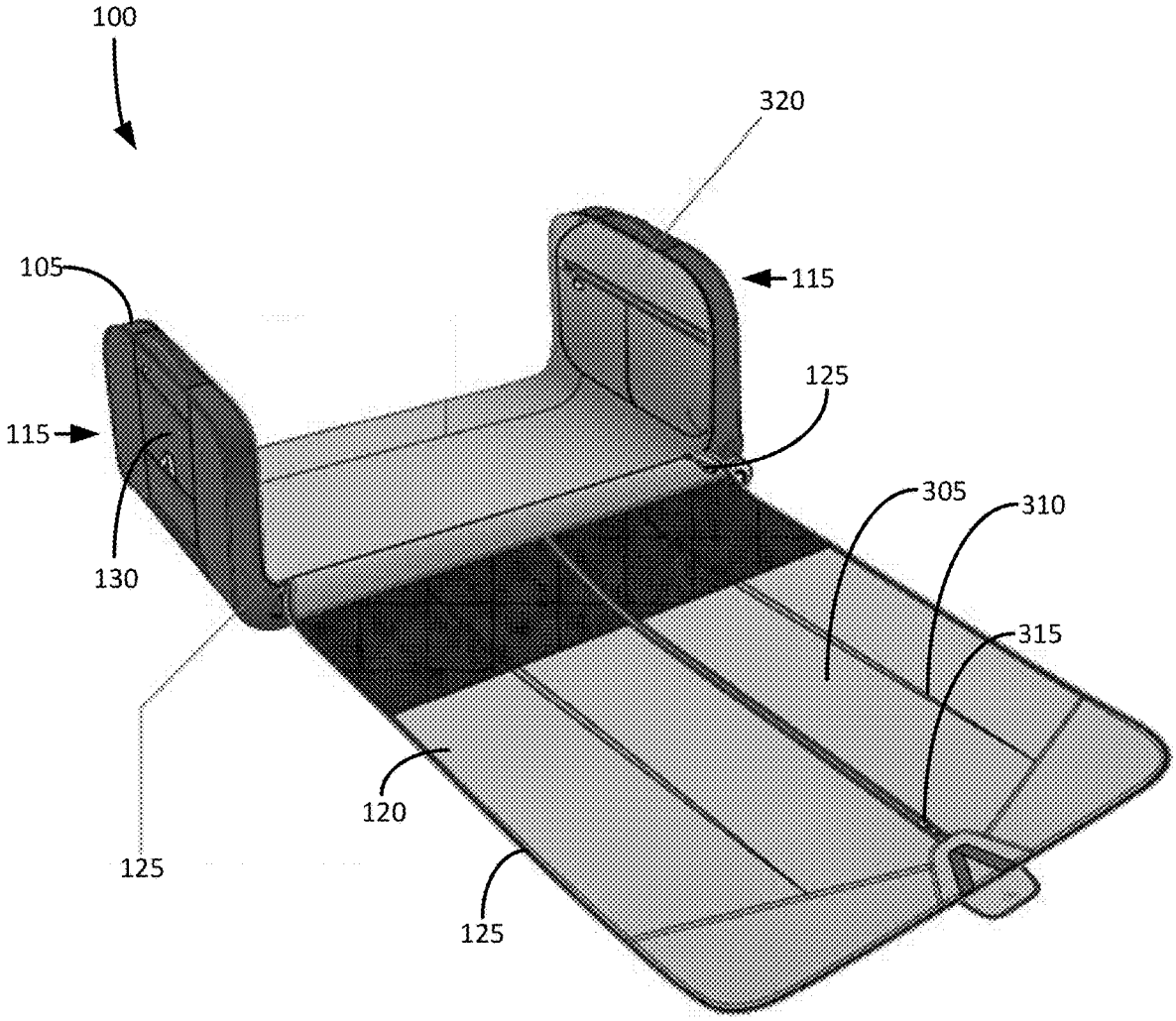
FIG. 3 illustrates the luggage bag of FIG. 1 in the opened configuration without the removable organizer, thereby revealing a detachable garment flap in accordance with various inventive concepts of the present invention.
Figure 4:
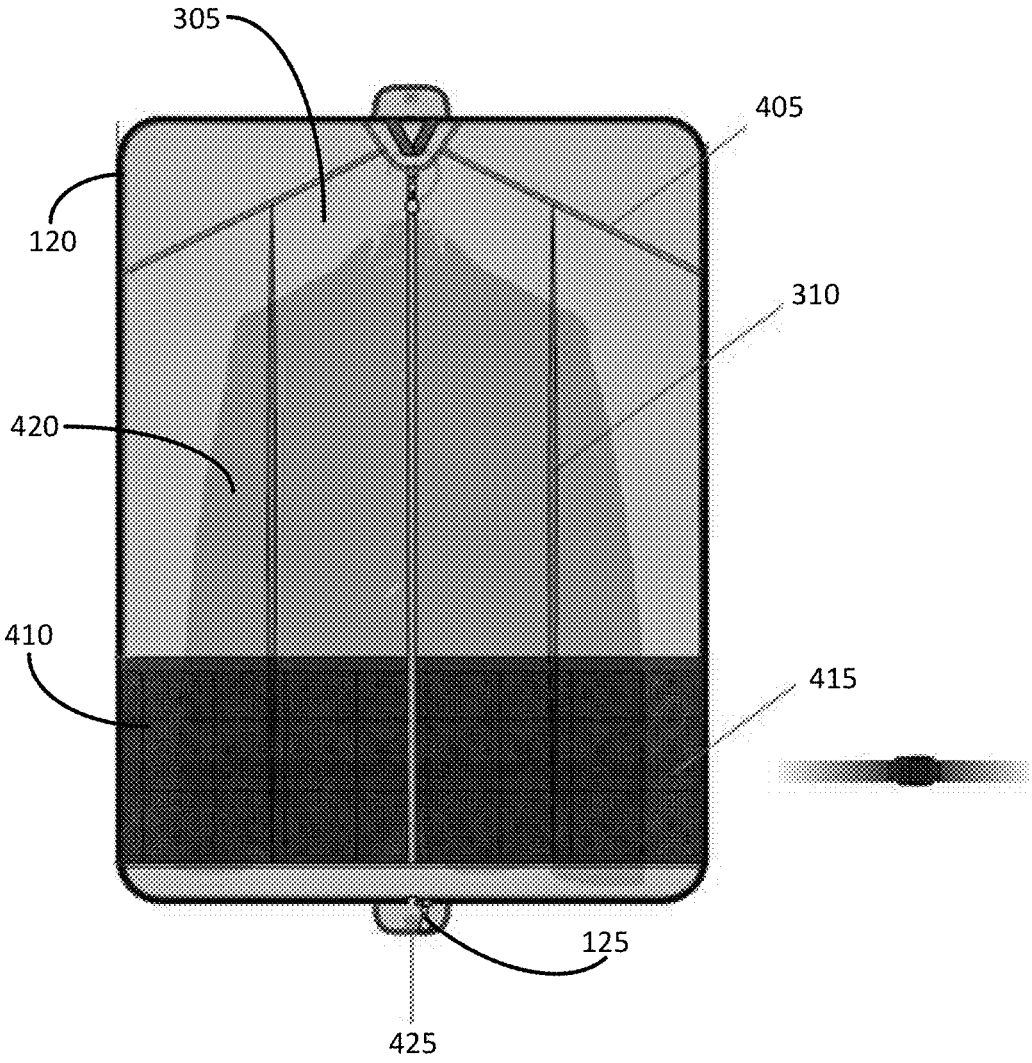
FIG. 4 illustrates the detachable garment flap of FIG. 3.

FIG. 3 illustrates the luggage bag 100 of FIG. 1 in the opened configuration without the removable organizer, thereby revealing a detachable garment flap 120 in accordance with various inventive concepts of the present invention. FIG. 4 illustrates the detachable garment flap 120 of FIG. 3. Reference is now made to FIGS. 1-4.

The closure flap 120 can be a detachable garment flap 120. The detachable garment flap 120 can include an envelope 305 in which garments such as suits, pants, shirts and the like can be neatly stored and transported. The detachable garment flap 120 is interchangeable with one or more different garment flaps to accommodate style preference, color, size, or the like. The envelope 305 can include one more pleated gussets 310 so that the volume of the envelope can automatically expand to accommodate multiple garments. The detachable garment flap 120 can be attached or detached to and from the luggage bag 100 using connection means such as the zipper 125. Other suitable connection means can include Velcro®, buttons, snaps, or the like. The garment flap 120 can also include its own zipper 315 or other suitable opening and closing means such as Velcro®, buttons, snaps, or the like, to enable efficient and convenient access to the envelope 305.

Referring to FIG. 4, the detachable garment flap 120 can include one or more shoulder seams 405. The volume of the envelope 305 can stop or otherwise be defined at least in part by the one or more shoulder seams 405. The garment flap 120 can also include webbing 410 for added ventilation. In addition, the garment flap 120 can include a strap and buckle mechanism 415 or other similar means for gathering and/or securing a lower portion of the various garments 420 stored within the envelope 305. The detachable garment flap 120 can include one or more sub-flaps 425 for covering and/or securing the zipper 125, as further described below.

One or more cargo pockets 320 may be disposed within the container 105, for example, on inside regions of the walls 115. The one or more cargo pockets 320 can each include its own zipper 315 or other suitable opening and closing means such as Velcro®, buttons, snaps, or the like.

Figure 5A:
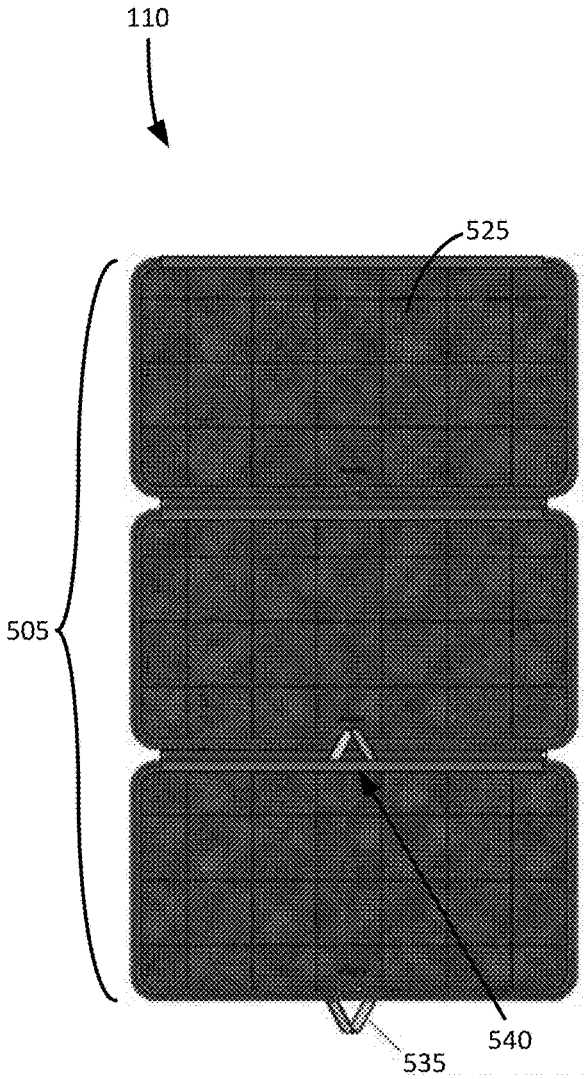
FIGS. 5A and 5B illustrate different views of the organizer of FIG. 1 including various compartments removed from the container of FIG. 1.
Figure 5B:
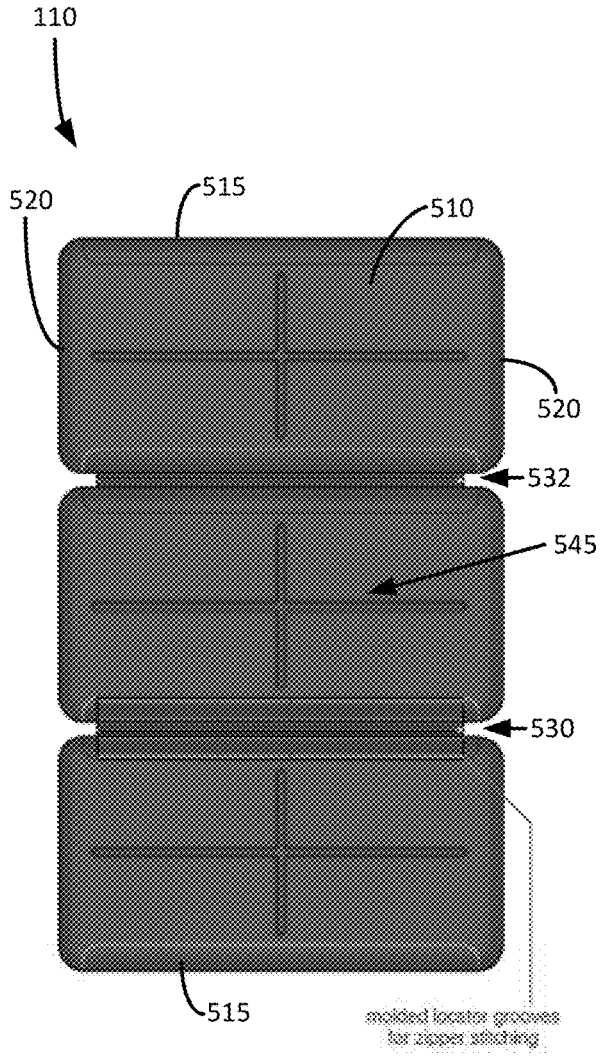
Figure 6:
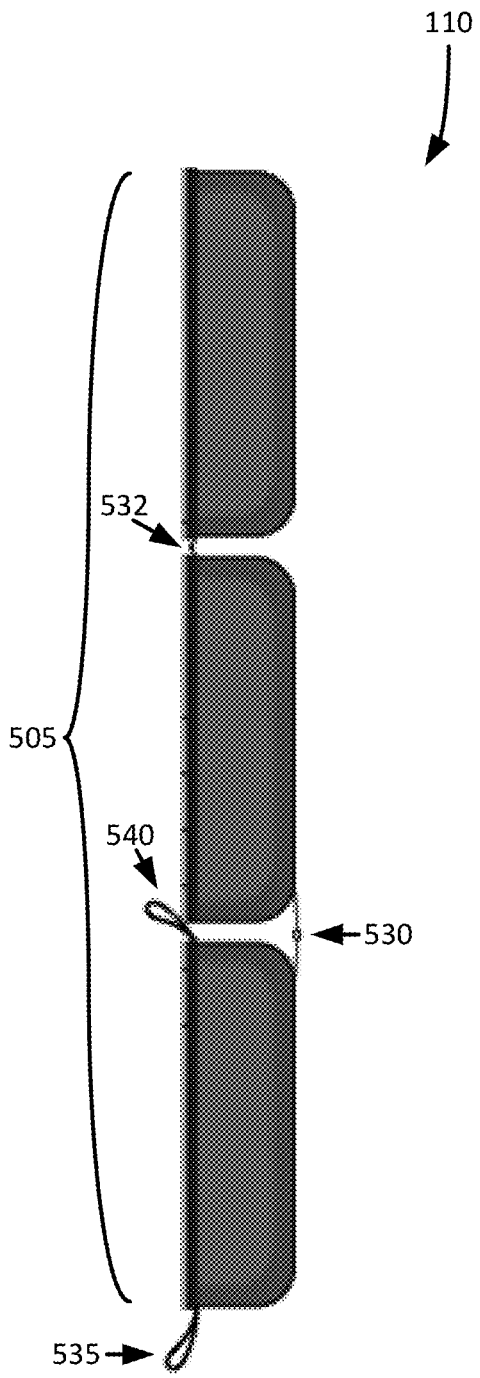
FIG. 6 illustrates another view of the organizer of FIG. 1.
Figure 7A:
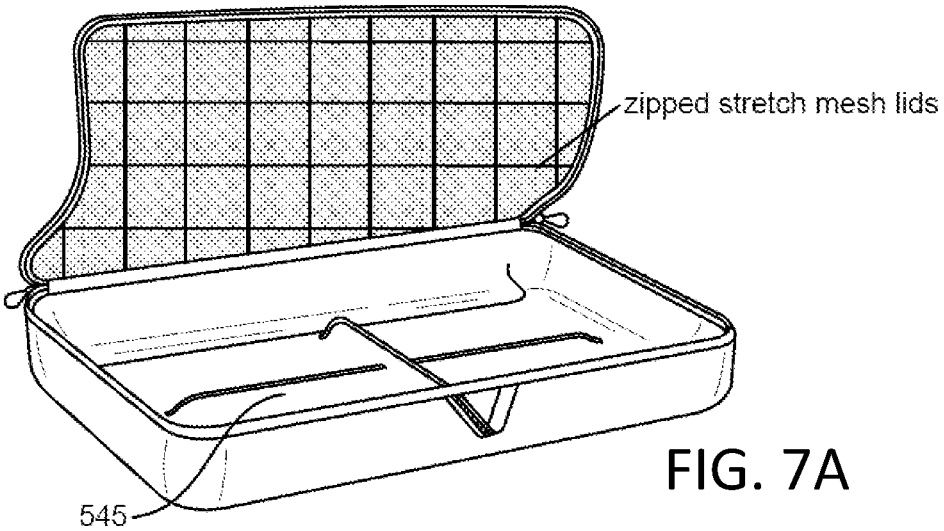
FIGS. 7A, 7B, and 7C illustrate various perspective views of a single compartment of the organizer of FIG. 1.
Figure 7B:
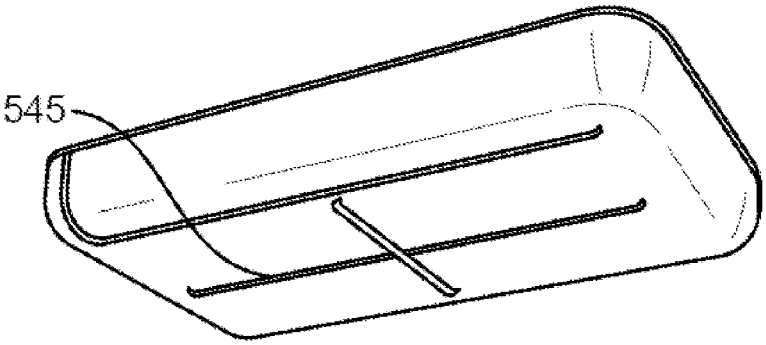
Figure 7C:
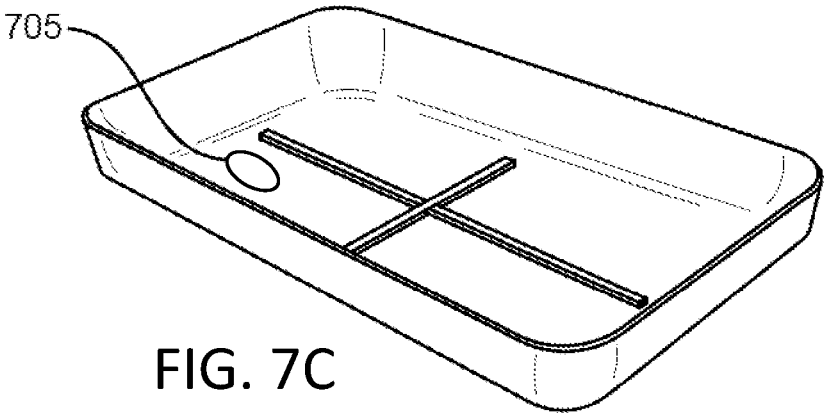
Figure 8:
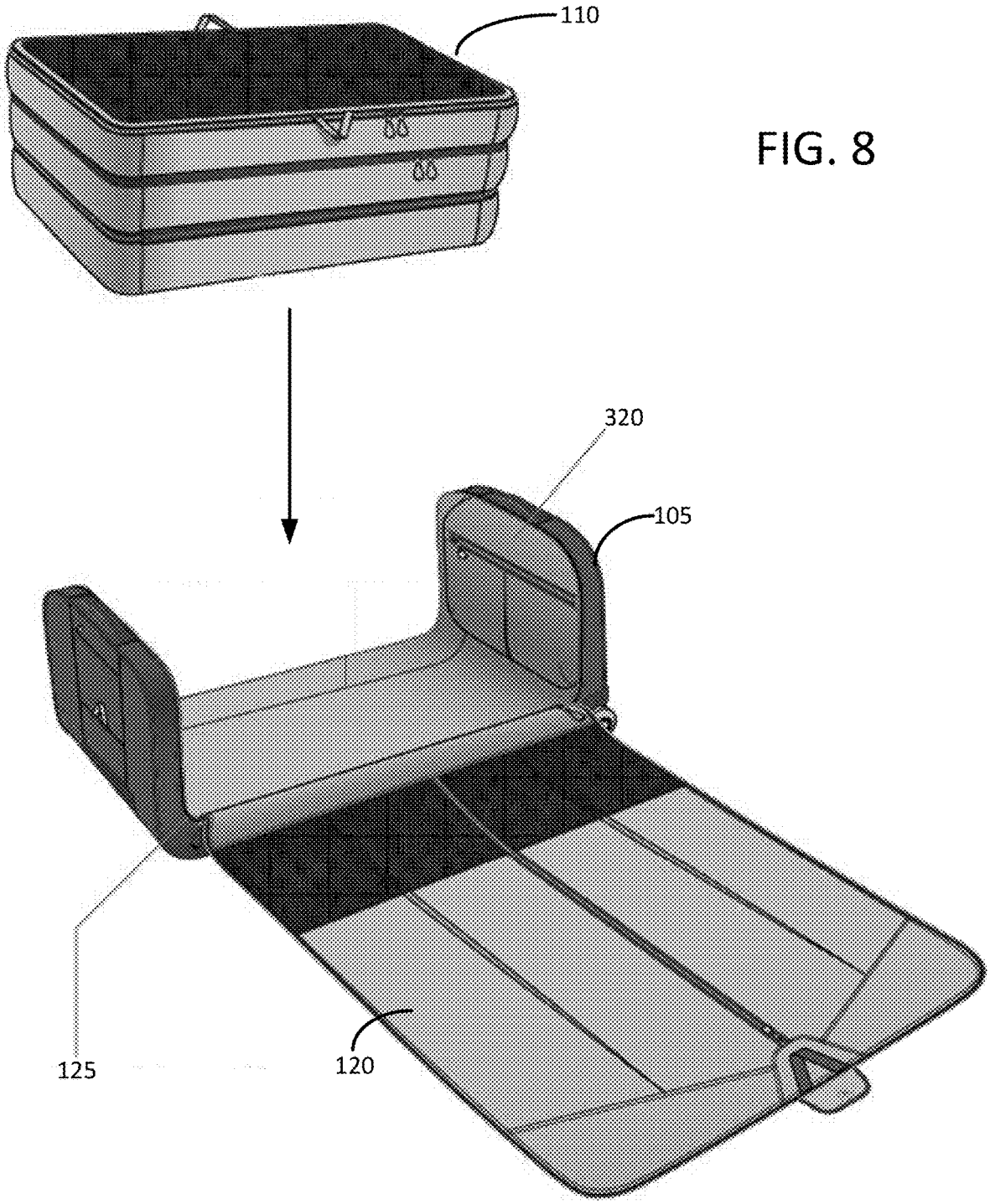
FIG. 8 illustrates the luggage bag of FIG. 1 including an outer container in an opened configuration and a removable organizer in a folded configuration in accordance with various inventive concepts of the present invention.

FIGS. 5A and 5B illustrate different views of the organizer 110 of FIG. 1 including various compartments 505 removed from the container of FIG. 1. FIG. 6 illustrates another view of the organizer 110 of FIG. 1. FIGS. 7A, 7B, and 7C illustrate various perspective views of a single compartment 505 of the organizer 110 of FIG. 1. FIG. 8 illustrates the luggage bag 100 of FIG. 1 including an outer container 105 in an opened configuration and a removable organizer 110 in a folded configuration in accordance with various inventive concepts of the present invention. Reference is now made to FIGS. 5A, 5B, 6, 7A, 7B, 7C, and 8.

The organizer 110 can include a plurality of hollow compartments 505. Each compartment 505 can include a plurality of walls 510, 515, 520, and 525 made out of compression molded material, which can include plastic, metal, rubber, composite material, or the like. Alternatively, the walls of each of the compartments 505 can be made of fabric or other suitable material. Each compartment 505 can be generally cuboid shaped. As such, each compartment 505 can include a bottom wall 510. Each compartment 505 can also include two long sidewalls 515 and two short sidewalls 520. The sidewalls 515 and 520 can trace the periphery of the bottom wall 510 and can extend substantially perpendicularly therefrom. The long sidewalls 515 can be opposite each other, and the short sidewalls 520 can be opposite each other.

Each compartment 505 can further include a top wall 525, which can be connected to the sidewalls 515 and 525, and that is opposite the bottom wall 510. The bottom wall 510 and sidewalls 515 and 520 can be substantially opaque while the top wall 525 can be at least partially light-transmissive. For instance, the top wall 525 can be made of a see-through mesh material and/or stretch-mesh material. The top wall 525 can also be at least partially removably attached to one or more of the sidewalls 515 and 520, for instance, via a zipper, snaps, or other closure. Accordingly, the top wall 525 can be detached (e.g., unzipped) from one or more of the sidewalls 515 and 520 to provide access into the compartment 505, and items can be placed within the compartment 505. Then, the top wall 525 can be selectively attached (e.g., zipped) to the sidewalls 515 and 520 to secure the items within the compartment 505.

The organizer 110 can include any suitable number of individual compartments 505. In the embodiments shown, there are three compartments 505, and the compartments fold and stack on each other. Thus, as shown in FIG. 8, the organizer 110 can be folded and stacked to be stored within the outer container 105, and the garment flap 120 can be closed over and can encapsulate the organizer 110. Then, when desired, the compartments 505 can be entirely removed from the container 105 and unfolded to deploy and extend from the container 105 as shown in FIG. 1. Moreover, the organizer 110 can be completely removed from the container 105 as shown in FIG. 8.

As shown in FIGS. 5A, 5B, and 6, the compartments 505 can be connected to each other via connector 530 and connector 532. The connectors 530 and 532 can be stitching or other type that permanently fixes the compartments 505 together. In other embodiments, the connectors 530 and 532 can be a zipper, pile tape (e.g., VELCRO™), snaps, buttons, or other suitable connector for removably connecting the compartments 505. The compartments 505 can be aligned (when unfolded) such that adjacent long sidewalls 515 are connected together. Also, the connector 530 can be located along one edge or region of the bottom wall 510. The connector 532 can be located along one edge or region of the top wall 525. For instance, the bottom connector 530 can connect adjacent bottom walls 510, and the top connector 532 can connect adjacent top walls 525.

The middle compartment 505 of the organizer 110 includes the bottom connector 530 on one side and the top connector 532 on the opposite side. The top and bottom connectors 530 and 532 can, thus, alternate along the entire length of the organizer 110 such that the compartments 505 can stack up in sequence in a compact manner. The organizer 110 can be modular such that the compartments 505 can be configured in any desirable manner. For example, one or more compartments 505 can be attached and added to the organizer 110, or one or more compartments 505 can be detached and removed from the organizer 110.

Also, in some embodiments, the compartments 505 can include available connectors (e.g., 530 and 532) extending along the short sidewalls 520 as well as along the long sidewalls 515 such that the compartments 505 can unfold to be aligned or transverse to each other. This modularity allows the organizer 110 to be configured as desired. The various compartments are foldable one atop the other. The organizer 110 can, thus, take up substantially the entire interior volume of the outer container 105 or less than the entire interior volume.

The organizer 110 can also include a first pull handle 535 or strap and a second pull handle 540 or strap. The pull handles can be, for example, a molded rubber pull or handle. Alternatively, the pull handles can be made of material, metal, plastic, or the like. The pull handles 535 and 540 can be located on the organizer 110 to facilitate moving the organizer 110 into and out of the outer container 505. For instance, the first pull handle 535 can be fixed to the outermost compartment 505, located at the end of the organizer 110, and the first pull handle 535 can be pulled to unfold, and deploy the organizer 110 from the container 105. Also, the compartment 505 at the end of the organizer 110 opposite the first pull handle 535 can be removably coupled to the container 105 (e.g., by pile tape, snaps, etc.) to facilitate deployment of the organizer 110 from the container 105.

Furthermore, as shown in FIGS. 5A, 5B, and 6, the second pull handle 540 can be included between the middle compartment 505 and the outermost compartment 505, and the second pull handle 540 can be lifted such that gravity causes folding of the compartments 505 on each other. The second pull handle 540 can then be used to further fold the compartments 505 on each other and move the organizer 110 into the container 105.

Also, when the organizer 110 is deployed from the container 105, the compartments 505 can face the same direction such that the top walls 525 are each aligned in a substantially continuous row. As such, the contents of each of the compartments 505 can be visible, and the compartments 505 can be highly accessible when deployed from the container 105.

It will be appreciated that the organizer 110 can be used within any suitable container and/or can be used and sold independently from the outer container 105. Also, individual compartments 505 can be sold separately and added to the organizer 110 as needed. Moreover, the compartments 505 within the organizer 510 can include interior dividing walls 545 for further separating or securing items within the respective compartment 505. The dividing walls 545 can be molded into the individual compartments 505 and/or have a height that is less than the height of the walls of each compartment 505. A debossed logo 705 can be imprinted directly into one or more of the walls 510.

Figure 9A:
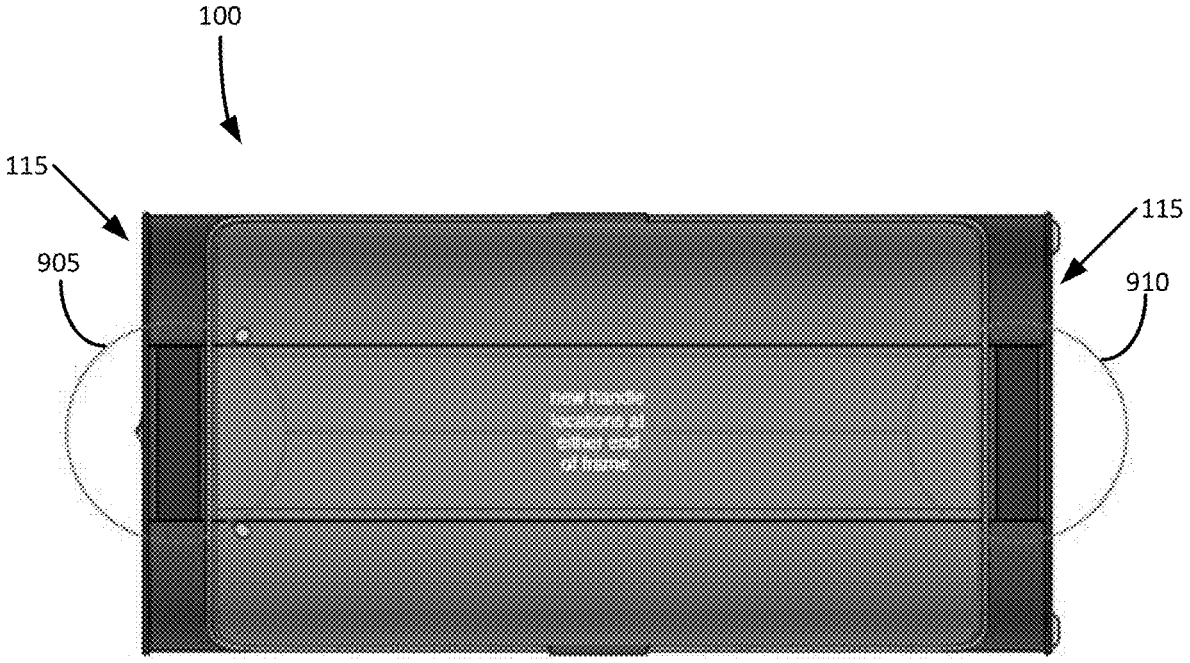
FIGS. 9A and 9B illustrate the luggage bag of FIG. 1 in the closed configuration, including multiple grab handles disposed thereon.
Figure 9B:
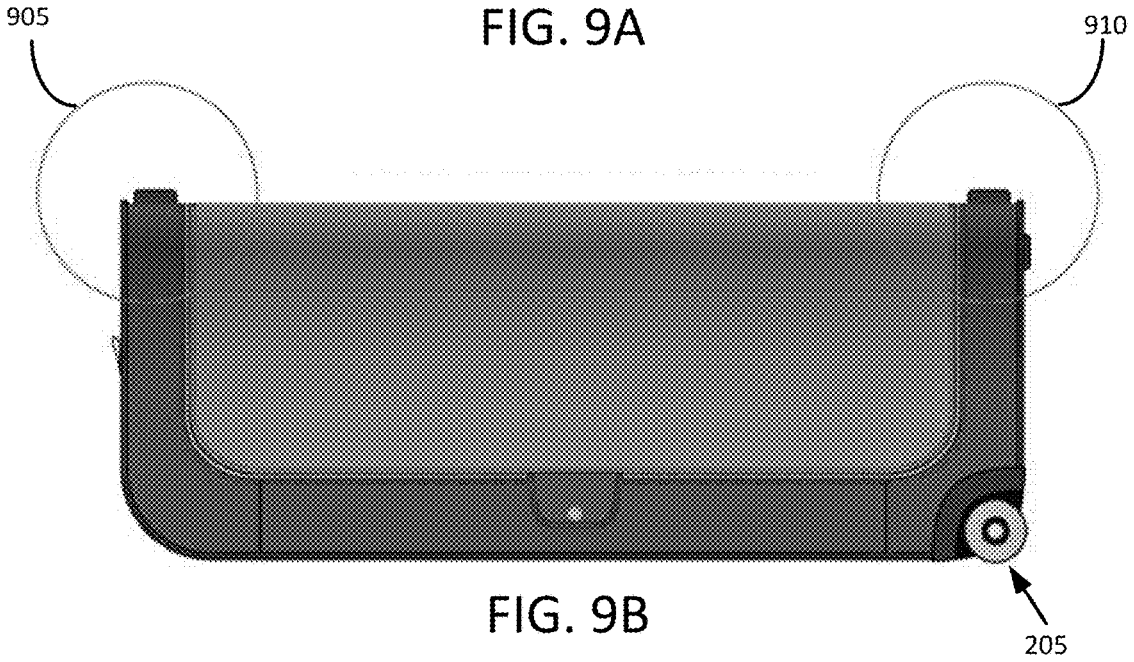

FIGS. 9A and 9B illustrate the luggage bag 100 of FIG. 1 in the closed configuration, including multiple grab handles 905 and 910 disposed thereon. As shown in FIGS. 9A and 9B, the luggage bag 100 can include a first grab handle 905 disposed atop one of the walls 115 opposite the telescoping handle 210 (FIG. 2). In addition, the luggage bag 100 can include a second grab handle 910 disposed atop another of the walls 115 opposite the one or more wheels 205. In this manner, the first and second grab handles 905 and 910 provide two-handed horizontal lifting from a trunk or baggage carousel, for example.

Figure 10:
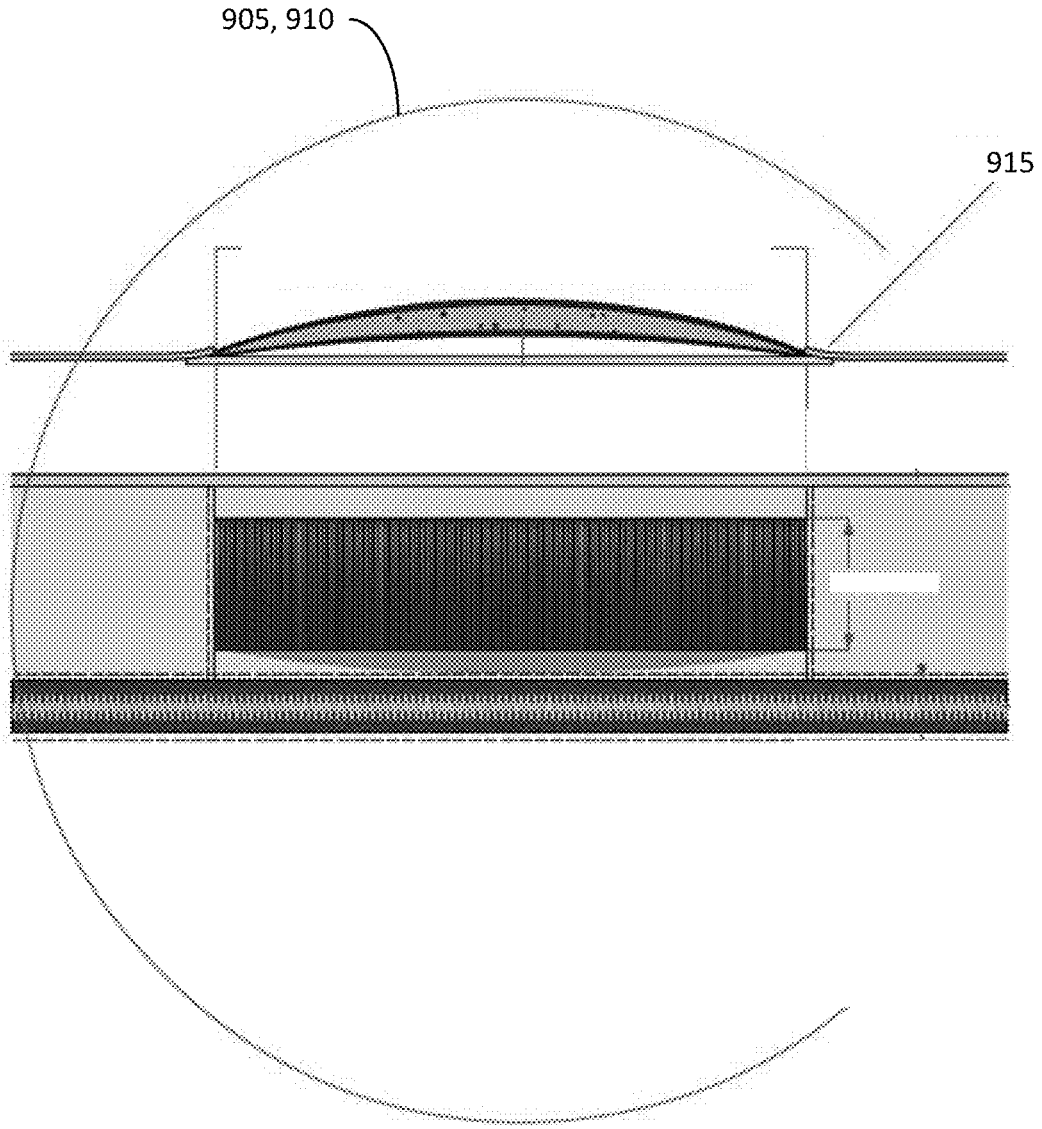
FIG. 10 illustrates a close-up view of a grab handle of FIGS. 9A and 9B.

FIG. 10 illustrates a close-up cross sectional view of the grab handles of FIGS. 9A and 9B. As can be seen, the grab handles can be captured and secured at seams 915. In addition, the grab handles 905 and 910 can be made of tubular webbing that is stuffed with cross-link foam or other suitable stuffing material. In this manner, the grab handles 905 and 910 provide comfortable and efficient lifting access to the luggage bag 100.

Figure 11:
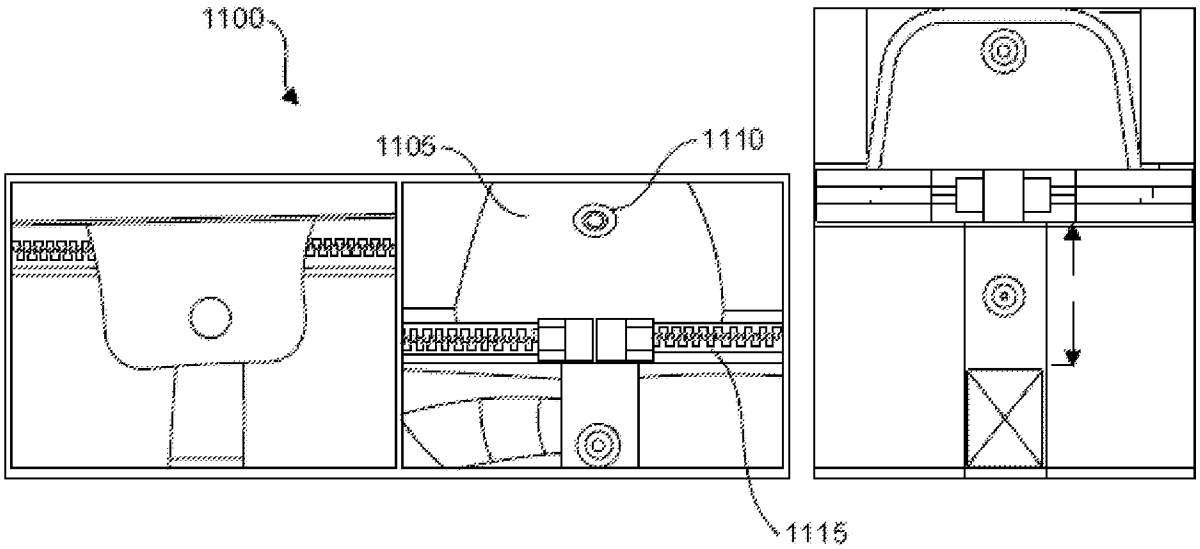
FIG. 11 illustrates a close-up of an example of a detachable zipper and flap construction.

FIG. 11 illustrates a close-up of an example of a detachable zipper and flap mechanism 1100. The detachable zipper and flap mechanism 1100 can include a connective cover flap 1105, which may include a securing means such as a snap 1110. The connective cover flap 1105 may fold down over an adjoining zipper section 1115 and snap into place using the securing means 1110. The connective cover flap 1105 may therefore cover and secure one or more locations on the luggage bag 100 where zippers or other connectors meet.

Thus, the luggage bag 100 is very portable and can securely store items within the organizer 110 in an orderly manner. The organizer 110 can also be configured in a wide variety of ways according to the desires of the user. In a single motion, the luggage bag 100 can be transformed from limited access to the contents to complete access almost instantaneously while maintaining organization of the contents. Similarly, in another single motion, the compartments of the organizer 110 can be quickly and conveniently folded back into the outer container 105 of the luggage bag 100.

Figure 12:
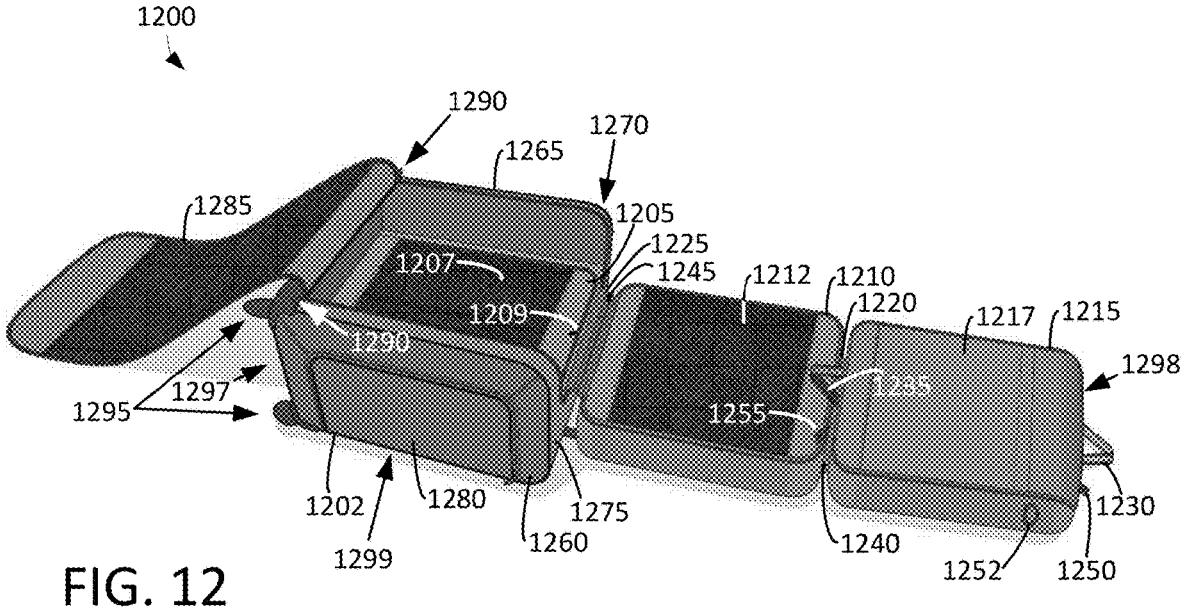
FIG. 12 illustrates a perspective view of an overhead luggage bag including an outer container in an opened configuration, a built-in compartment within the outer container, and first and second removable compartments in accordance with various inventive concepts of the present invention.

FIG. 12 illustrates a perspective view of an overhead luggage bag 1200 including an outer container 1202 in an opened configuration, a built-in compartment 1205 within the outer container 1202, a first removable compartment 1210, and a second removable compartment 1215 in accordance with various inventive concepts of the present invention. The outer container 1200 can be constructed, for example, of rugged cloth material, lining materials such as polyester, lightweight metals such as aluminum, hard or rigid plastics, composite materials, or any other suitable kind of material. In some embodiments, the entire outer container 1202 can be constructed of a metal such as molded aluminum. Other materials can be used to construct the entire outer container such as a metal amalgam, a composite material, a cloth material, or the like.

The outer container 1202 can include an organizer having the built-in compartment 1205, the first removable compartment 1210, and the second removable compartment 1215. The organizer can include a first connector 1220, which can connect and disconnect the first removable compartment 1210 to and from the second removable compartment 1215 using, for example, one or more zippers 1240. The organizer can include a second connector 1225, which can connect and disconnect the first removable compartment 1210 to and from the built-in compartment 1205 using, for example, one or more zippers 1245.

For example, the first connector 1220 and/or the second 1225 can include stitching or other material type that permanently fixes the compartments together. In other embodiments, the connectors 1220 and/or 1225 can include one or more zippers (e.g., 1240 and 1245), pile tape (e.g., VELCRO™), snaps, buttons, or other suitable connector for removably connecting the compartments. The compartments 1210 and 1215 can be aligned (when unfolded) such that adjacent sidewalls are connected together.

The organizer can include a first pull handle or strap 1230 connected to the second removable compartment 1215, and a second pull handle or strap 1235 connected to the second removable compartment 1215. The first pull handle or strap 1230 can unfold and deploy the first and second removable compartments 1210 and 1215 from the outer container 1202. The second pull handle or strap 1235 can fold the first and second removable compartments 1210 and 1215 one atop the other into the outer container 1202 atop the built-in compartment 1205.

The outer container 1202 can include a first rigid sidewall 1260 disposed at a first end of the outer container 1202, and a second rigid sidewall 1265 disposed at a second end opposite the first end of the outer container 1202. The first rigid sidewall 1260 and/or second rigid sidewall 1265 can include one or more curved corners (e.g., 1270) that maintain their shape whether in an open configuration or a closed configuration. The outer container 1202 can include an outer flap 1285 configured to be attached to the first rigid sidewall 1260 and/or to the second rigid sidewall 1265 along the one or more curved corners (e.g., 1270), such that the outer flap 1285 can cover the first and second removable compartments 1210 and 1215 within the outer container 1202.

The outer container 1202 can include a third rigid wall 1297 disposed at a third end perpendicular to the first and second rigid sidewalls 1260 and 1265. A plurality of casters or wheels 1295 can be disposed on the third rigid wall 1297 of the outer container 1202. The outer flap 1285 can be attached to the first rigid sidewall 1260 and/or to the second rigid sidewall 1265, such that the outer flap 1285 can cover the first and second removable compartments 1210 and 1215 within the outer container 1202. The outer container 1202 can include a fourth rigid wall 1275 opposite the third rigid wall 1297. The outer container 1202 can include a rigid support wall 1299 that is perpendicular to the first rigid sidewall 1260, the second rigid sidewall 1265, the third rigid wall 1297, and the fourth rigid wall 1275. The outer flap 1295 can be at least partially removably attached to one or more of the first rigid sidewall 1260, the second rigid sidewall 1265, and/or the fourth rigid wall 1275 of the outer container 1202, for instance, via one or more zippers 1290, snaps, or other closure.

The built-in compartment 1205 can include a support wall corresponding with the rigid support wall 1299 of the outer container 1202, an inner access flap 1207, and first, second, third, and fourth sidewalls. In other words, the rigid support wall 1299 and lower portions of the first and second rigid sidewalls 1260 and 1265 of the outer container 1202, and lower portions of the rigid third and fourth walls 1297 and 1275, can correspond to a support wall and sidewalls of the built-in compartment 1205. Put differently, the rigid support wall 1299 can also act as the support wall for the built-in compartment 1205, a lower portion of the first rigid sidewall 1260 of the outer container 1202 can act as a sidewall of the built-in compartment 1205, a lower portion of the second rigid sidewall 1265 of the outer container 1202 can act as another sidewall of the built-in compartment 1205, a lower portion of the third rigid sidewall 1297 of the outer container 1202 can act as yet another sidewall of the built-in compartment 1205, and a lower portion of the fourth rigid sidewall 1275 of the outer container can act as still another sidewall of the built-in compartment 1205.

The inner access flap 1207 of the built-in compartment can be at least partially light-transmissive. For example, the inner access flap 1207 can be made of a see-through mesh material and/or stretch-mesh material. The support wall and the first, second, third, and fourth sidewalls of the built-in compartment 1205 can be substantially opaque. The inner access flap 1207 can also be at least partially removably attached to one or more of the sidewalls of the built-in compartment 1205, for instance, via one or more zippers 1209, snaps, or other closure. Accordingly, the inner access flap 1207 can be detached (e.g., unzipped) from one or more of the sidewalls of the built-in compartment 1205 to provide access into the built-in compartment 1205, and items can be placed within the built-in compartment 1205. Then, the inner access flap 1207 can be selectively attached (e.g., zipped) to the sidewalls to secure the items within the built-in compartment 1205.

The first removable compartment 1210 can include a support wall, an inner access flap 1212, and first, second, third, and fourth sidewalls, that are separate and spaced apart from the built-in compartment 1205 and the second removable compartment 1215. The support wall and the first, second, third, and fourth sidewalls of the first removable compartment 1210 can be substantially opaque and/or made of compression molded material. The support wall of the first removable compartment 1210 can lay flat atop a surface when in an unfolded configuration.

The inner access flap 1212 of the first removable compartment 1210 can be at least partially light-transmissive. For example, the inner access flap 1212 can be made of a see-through mesh material and/or stretch-mesh material. The inner access flap 1212 can also be at least partially removably attached to one or more of the sidewalls of the first removable compartment 1212, for instance, via one or more zippers 1255, snaps, or other closure. Accordingly, the inner access flap 1212 can be detached (e.g., unzipped) from one or more of the sidewalls of the first removable compartment 1210 to provide access into the first removable compartment 1210, and items can be placed within the first removable compartment 1210. Then, the inner access flap 1212 can be selectively attached (e.g., zipped) to the sidewalls to secure the items within the first removable compartment 1210.

The second removable compartment 1215 can include a support wall, an inner access flap 1217, and first, second, and third sidewalls that are separate and spaced apart from the built-in compartment 1205 and the first removable compartment 1210. The support wall and the first, second, third, and fourth sidewalls of the second removable compartment 1215 can be substantially opaque and/or made of compression molded material. The support wall of the second removable compartment 1215 can lay flat atop a surface when in an unfolded configuration.

The inner access flap 1217 of the second removable compartment 1215 can be substantially opaque. The inner access flap 1217 can be at least partially removably attached to one or more of the sidewalls of the second removable compartment 1215, for instance, via one or more zippers 1250, snaps, or other closure. Accordingly, the inner access flap 1217 can be detached (e.g., unzipped) from one or more of the sidewalls of the second removable compartment 1215 to provide access into the second removable compartment 1215, and items can be placed within the second removable compartment 1215. Then, the inner access flap 1217 can be selectively attached (e.g., zipped) to the sidewalls to secure the items within the second removable compartment 1215. Moreover, the inner access flap 1217 can curve around an end of the second removable compartment 1215 such that the inner access flap 1217 acts as a portion of a sidewall of the second removable compartment 1215 as shown at 1298, and as further described below.

The second pull handle or strap 1235 can be lifted such that the second removable compartment 1215 can be folded on the first removable compartment 1210, and the first removable compartment 1210 can be folded on the built-in compartment 1205, in a folded configuration. In the folded configuration, the built-in compartment 1205 and the second removable compartment 1210 can be in an upright orientation, and the first removable compartment 1215 can be in an inverted orientation, relative to each other. The organizer including the various compartments can fit in a folded configuration between the first rigid wall 1260 and the second rigid wall 1265 within the outer container 1202.

The overhead luggage bag 1200 can include an external-access storage area 1280 disposed on an outer surface of at least one of the first rigid wall 1260 or the second rigid wall 1265. The second removable compartment 1215 can include a D-ring 1252 to assist in unfolding the compartments and/or carrying the second removable compartment 1215.

Figure 13:
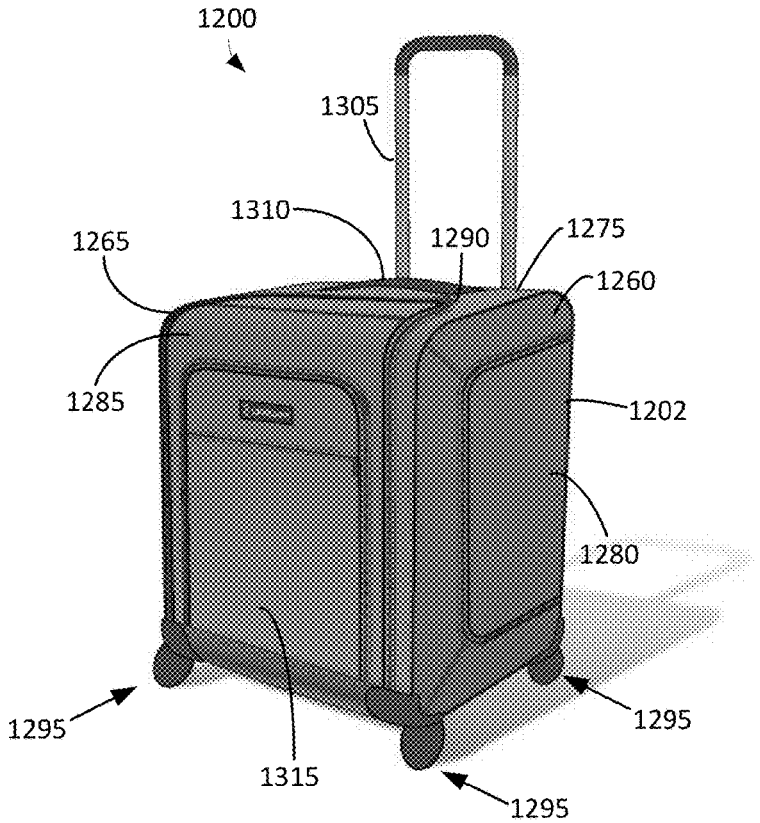
FIG. 13 illustrates a perspective view of the overhead luggage bag of FIG. 12 in a closed configuration.

FIG. 13 illustrates a perspective view of the overhead luggage bag 1200 of FIG. 12 in a closed configuration. Some elements shown in FIG. 13 are described in detail above, and therefore a detailed description of such elements is not necessarily repeated. The overhead luggage bag 1200 can include an external-access storage area 1315 disposed on an outer side of the outer flap 1285, which can store a notebook, papers, a laptop computer, airline ticket information, or the like.

The overhead luggage bag 1200 can include a telescoping handle 1305. It will be appreciated, that the container 1202 can vary in many ways from the container 1202 shown in the Figures. Indeed, the container 1202 can be of any suitable type, can have any suitable shape, and can incorporate one or more additional features typically found on other bags, luggage, briefcases, handbags, purses, and the like. The overhead luggage bag 1200 can include one or more grab handles 1310 disposed atop the rigid wall 1275 adjacent the telescoping handle 1305.

Figure 14:
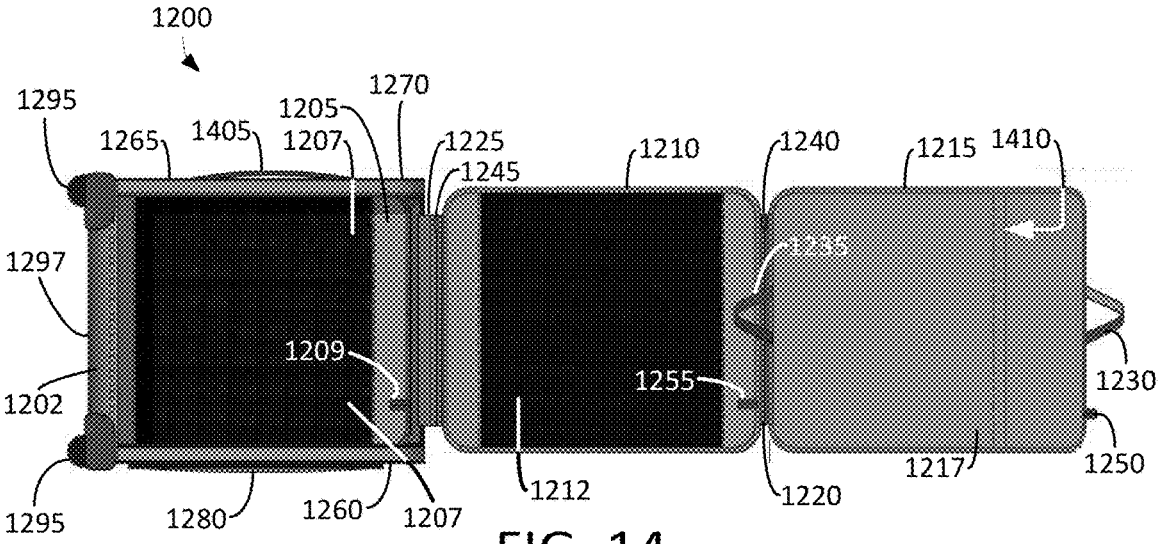
FIG. 14 illustrates a plan view of the overhead luggage bag of FIG. 12 in an opened configuration.

FIG. 14 illustrates a plan view of the overhead luggage bag 1200 of FIG. 12 in an opened configuration. Some elements shown in FIG. 14 are described in detail above, and therefore a detailed description of such elements is not necessarily repeated. The overhead luggage bag 1200 can include a second grab handle 1405 disposed on the rigid sidewall 1265 opposite the rigid sidewall 1260 having the external-access storage area 1280. In this manner, the two grab handles 1310 (of FIG. 13) and 1405 (of FIG. 14) provide two-handed grabbing and lifting from an overhead compartment in an airplane, from a trunk of a vehicle, from a baggage carousel, or the like. The overhead luggage bag 1200 can include a slip pocket 1410 in which relatively flat items such as papers, notebooks, or the like, can be conveniently stored.

Figure 15:
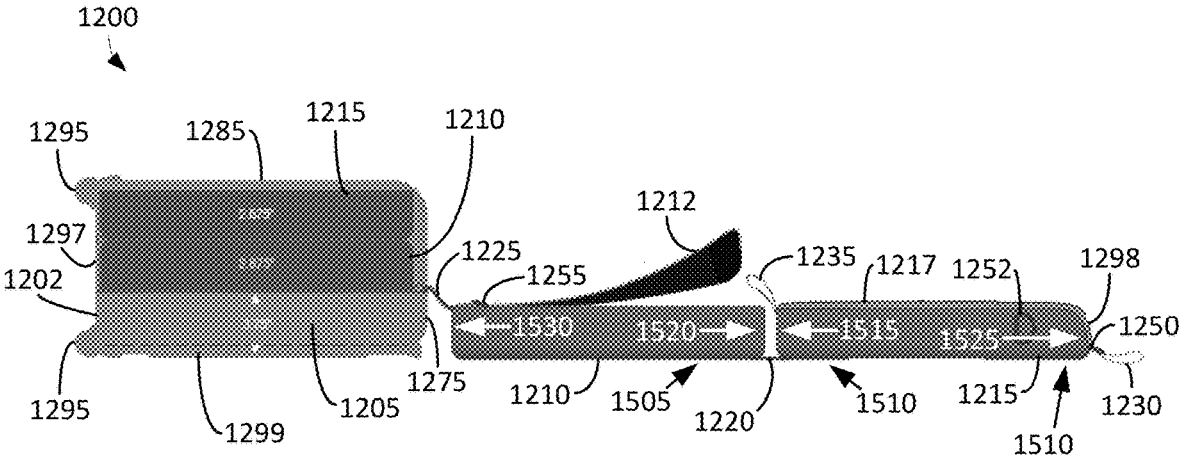
FIG. 15 illustrates a side elevation view of the overhead luggage bag of FIG. 12 showing the relative positions of the built-in and removable compartments in both closed and open configurations.

FIG. 15 illustrates a side elevation view of the overhead luggage bag 1200 of FIG. 12 showing the relative positions of the built-in and removable compartments in both closed and open configurations. Some elements shown in FIG. 15 are described in detail above, and therefore a detailed description of such elements is not necessarily repeated.

The first connector 1220 can be located along one region of a support wall 1505 of the first removable compartment 1210. The first connector 1220 can connect the second removable compartment 1215 to the first removable compartment 1210 such that the first connector 1220 connects the support wall 1505 of the first removable compartment 1210 and a support wall 1510 of the second removable compartment 1215. The second connector 1225 can be located along another region of the inner access flap 1212 of the first removable compartment 1210. The second connector 1225 can connect the first removable compartment 1210 to the built-in compartment 1205.

The first connector 1220 can be located along one edge or region of the support wall 1505, the sidewall 1520, the support wall 1510, and/or the sidewall 1515. The second connector 1225 can be located along one edge or region of a sidewall 1530 of the first removable compartment 1210 and/or a sidewall of the built-in compartment 1205.

The first pull handle or strap 1230 can be connected at an end of the second removable compartment 1215 in a first region including a support wall 1510 of the second removable compartment 1215. The second pull handle or strap 1235 can be connected in a second region including a sidewall 1515 of the second removable compartment 1215 opposite a sidewall 1520 of the first removable compartment 1210. In some embodiments, the second pull handle or strap 1235 can be disposed between the first removable compartment 1210 and the second removable compartment 1215. For example, the second pull handle or strap 1235 can be disposed directly opposite the first connector 1220 relative to the sidewall 1515 of the second removable compartment 1215.

The inner access flap 1217 can curve around an end of the second removable compartment 1215, as shown at 1298, such that the inner access flap 1217 can act as a portion of a sidewall 1525 of the second removable compartment 1215. The one or more zippers 1250 can follow the curvature of the rounded sidewalls of the second removable compartment 1215. Disconnecting the inner access flap 1217 from the sidewall 1525 by unzipping the inner access flap 1217 in the region 1298 of the second removable compartment 1215 creates an easy-access portal into the second removable compartment 1215, as further described in detail below.

The second pull handle or strap 1235 can be lifted such that the second removable compartment 1215 can be folded on the first removable compartment 1210, and the first removable compartment 1210 can be folded on the built-in compartment 1205, in a folded configuration, as shown in FIG. 15. Also shown in FIG. 15 is the first and second removable compartments 1210 and 1215 in the unfolded configuration. Although dimensions in inches are shown in FIG. 15 of the various compartments, it will be understood that the compartments can have any suitable dimensions without departing from the inventive concepts disclosed herein.

The overhead luggage bag 1200 is very portable and can securely store items within the organizer in an orderly manner. The built-in compartment 1205 provides an internal access compartment while the removable compartments 1210 and 1215 can be easily deployed and/or separated from each other and from the built-in compartment 1205. The compartments 1205, 1210, and 1215 can also be configured in a wide variety of ways according to the desires of the user. In a single motion, the luggage bag 1200 can be transformed from limited access to the contents to complete access almost instantaneously while maintaining organization of the contents. Similarly, in another single motion, the compartments can be quickly and conveniently folded back into the outer container 1202 of the overhead luggage bag 1200.

The organizer can be modular such that the compartments 1210 and 1215 can be configured in any desirable manner. For example, one or more compartments (e.g., 1210 or 1215) can be attached and added to the overhead luggage bag 1200, or one or more compartments (e.g., 1210 or 1215) can be detached and removed from the overhead luggage bag 1200. This modularity allows the overhead luggage bag 1200 to be configured as desired. The various compartments are foldable one atop the other. The organizer can, thus, take up substantially the entire interior volume of the outer container 1202 or less than the entire interior volume.

Figure 16:
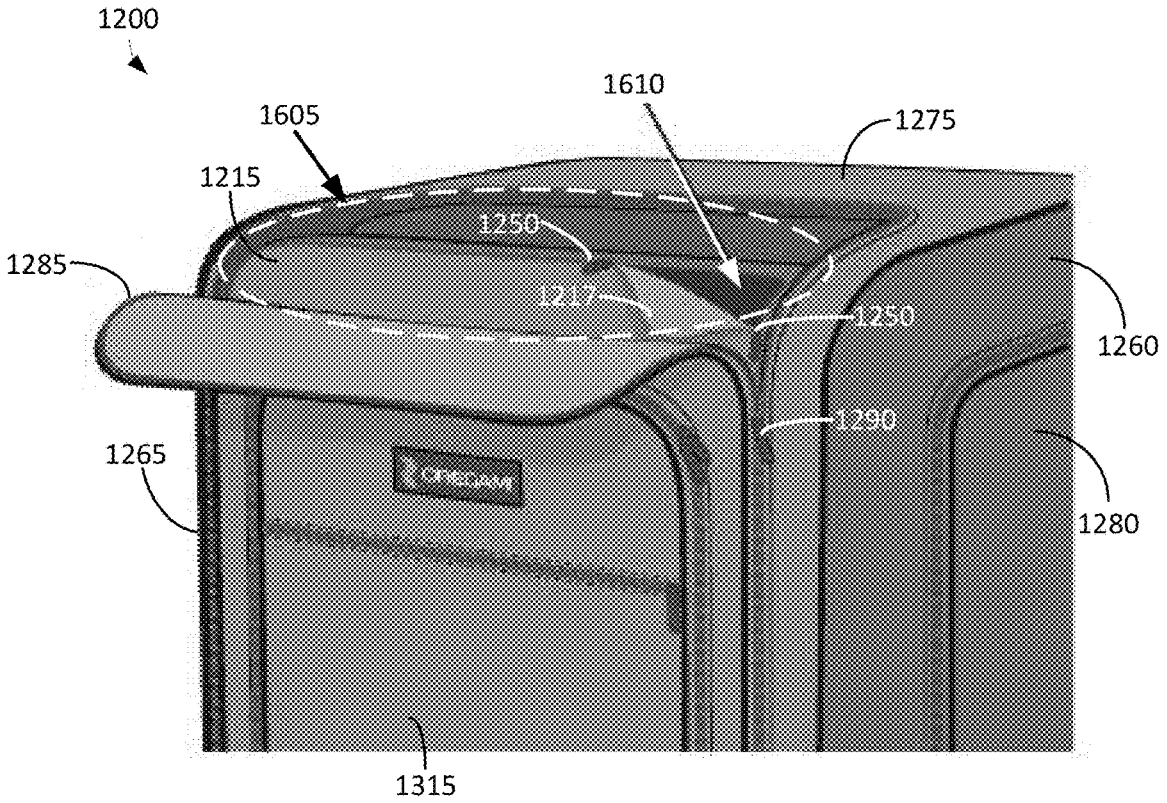
FIG. 16 illustrates a close-up view of a portion of the overhead luggage bag of FIG. 12 including an easy-access portal through which contents of the luggage bag can be conveniently accessed without fully opening the luggage bag.

FIG. 16 illustrates a close-up view of a portion of the overhead luggage bag 1200 of FIG. 12 including one or more easy-access portals (e.g., 1605 and 1610) through which contents of the luggage bag can be conveniently accessed without fully opening the luggage bag. Some elements shown in FIG. 16 are described in detail above, and therefore a detailed description of such elements is not necessarily repeated.

When in a closed configuration, contents of at least one of the removable compartments (e.g., 1215) can be accessed through an external easy-access portal 1605 without requiring the full opening and deployment of the internal compartments. The external easy-access portal 1605 can be associated with or otherwise pass through an opening in the fourth rigid wall 1275, through which contents of the second removable compartment 1215 can be accessed while the outer flap 1285 is substantially detached from the fourth rigid wall 1275 and substantially attached to the first and second rigid walls 1260 and 1265. In addition, the second removable compartment 1215 can include an internal easy-access portal 1610 through which the contents of the second removable compartment 1215 can be accessed. In other words, when the overhead luggage bag 1200 is in an upright position in which the casters or wheels 1295 are in contact with or otherwise substantially facing toward a floor, the outer flap 1285 can be partially unzipped using the one or more zippers 1290 or otherwise disconnected from the fourth rigid wall 1275 and/or partially unzipped using the one or more zippers 1290 or otherwise partially disconnected from the first and second rigid sidewalls 1260 and 1265, to provide access through the top of the luggage bag 1200 to the internal compartments. Then, the inner access flap 1217 can be partially unzipped using the one or more zippers 1250 or otherwise partially disconnected from one or more sidewalls of the second removable compartment 1215 for simple and convenient access to the items or contents stored within the second removable compartment 1215. Put differently, contents of the second removable compartment 1215 can be conveniently accessed through the internal easy-access portal 1610 and/or the external easy-access portal 1605, without unfolding or deploying the compartments from the outer container 1202.

Figure 17:
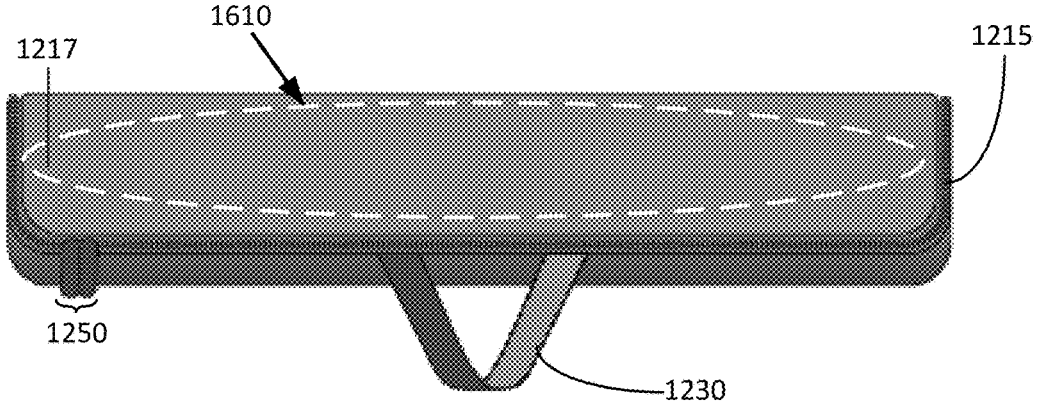
FIG. 17 illustrates an inner access flap and easy-access portal of a removable compartment of the overhead luggage bag of FIG. 12 in accordance with inventive concepts.

FIG. 17 illustrates an inner access flap 1217 and internal easy-access portal 1610 of a removable compartment 1215 of the overhead luggage bag 1200 of FIG. 12 in accordance with inventive concepts. Some elements shown in FIG. 17 are described in detail above, and therefore a detailed description of such elements is not necessarily repeated. The one or more zippers 1250 or other suitable fasteners can be used to partially detach the inner access flap 1217 from one or more sidewalls of the second removable compartment 1215, thereby opening up the internal easy access portal 1610.

Figure 18:
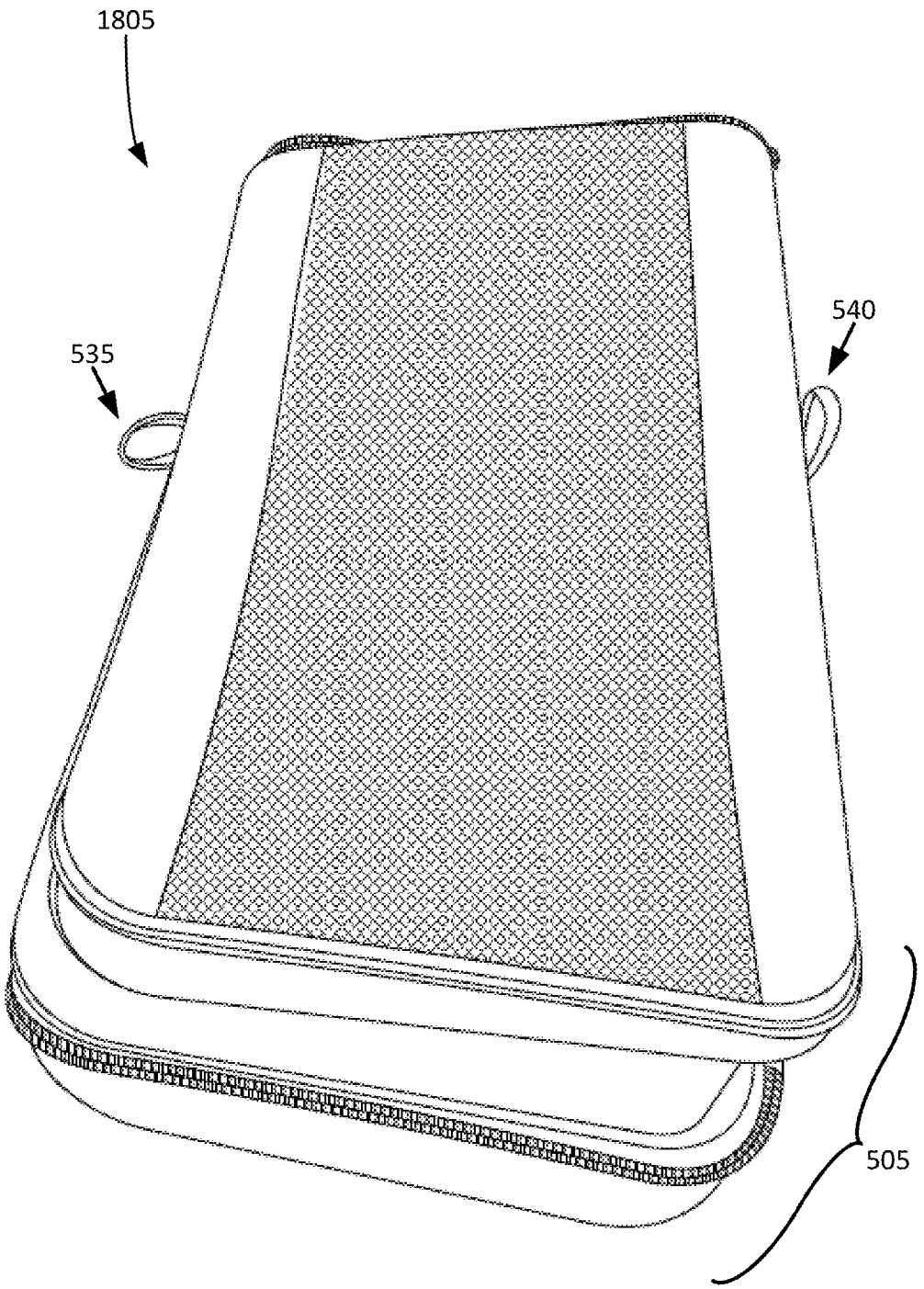
FIG. 18 illustrates an accessory organizer in a folded configuration in accordance with various inventive concepts of the present invention.

FIG. 18 illustrates an accessory organizer 1805 in a folded configuration in accordance with various inventive concepts of the present invention. The accessory organizer 1805 is a module collapsible accessory organizer for use with a luggage bag (e.g., 105 of FIG. 2). The accessory organizer includes foldable compartments 505, a first pull handle or strap 535, and a second pull handle or strap 540. The compartments 505 can each be collapsed down when necessary to free up interior volume of the luggage bag in which the accessory organizer is placed, as further explained below. The compartments 505 can each be collapsed down prior to being shipped, which reduces shipping cost because the total volume of the accessory organizer 1805 is significantly reduced. The compartments 505 can stack and fold onto each other, and be inserted into or removed from the luggage bag. The compartments 505 can be attached to each other. The compartments 505 are modular such that the accessory organizer 1805 can be configured to include any desired number of compartments 505. The compartments 505 of the accessory organizer 1805 are quickly unfolded and deployed for easy visibility and access to personal belongings stored therein, as also explained in more detail below.

The accessory organizer 1805 can be a standalone organizer when not stored in the luggage bag. The accessory organizer 1805 can be manufactured and shipped separately as a standalone organizer, and then used with a variety of already-existent luggage bags of various dimensions. Some travelers with larger items prefer an easier way to manipulate the shape, size and configuration of the accessory organizer 1805 within the structure and dimensions of the particular luggage bag itself. Moreover, some travelers prefer that the accessory organizer 1805 fit the particular luggage bag that they currently own and use because they prefer not to purchase an entirely new luggage bag. The accessory organizer 1805 can be made in a variety of sizes so that it can fit the dimensions of the traveler's particular bag, as also further described below. The accessory organizer 1805 can be constructed of light-weight fabrics and materials so that more personal belongings can be packed in to reduce the chance of any overweight charges being imposed by airline companies.

Figure 19:
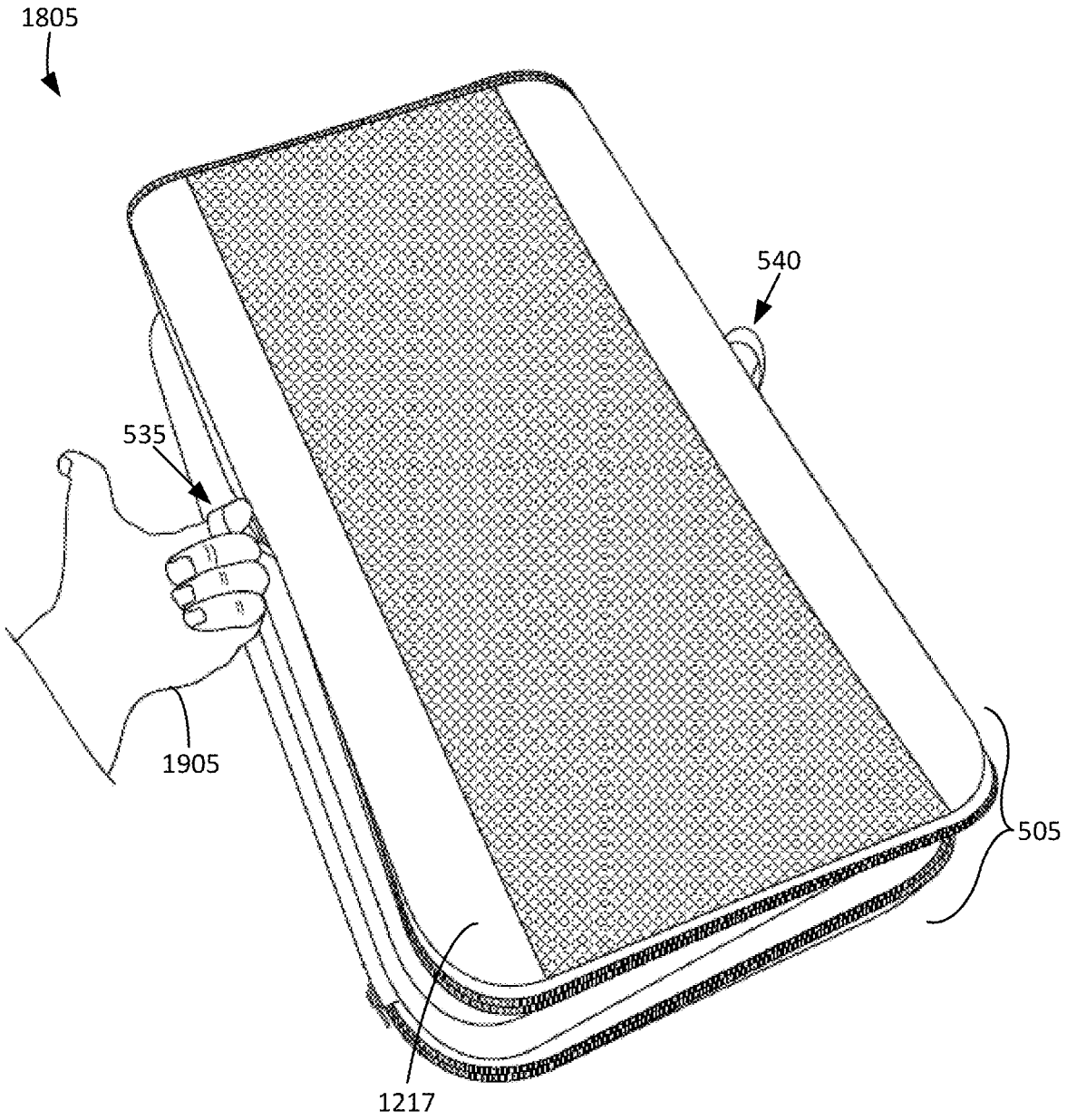
FIG. 19 illustrates the accessory organizer of FIG. 18 in the folded configuration with a human hand engaging with a first pull handle or strap.
Figure 20:
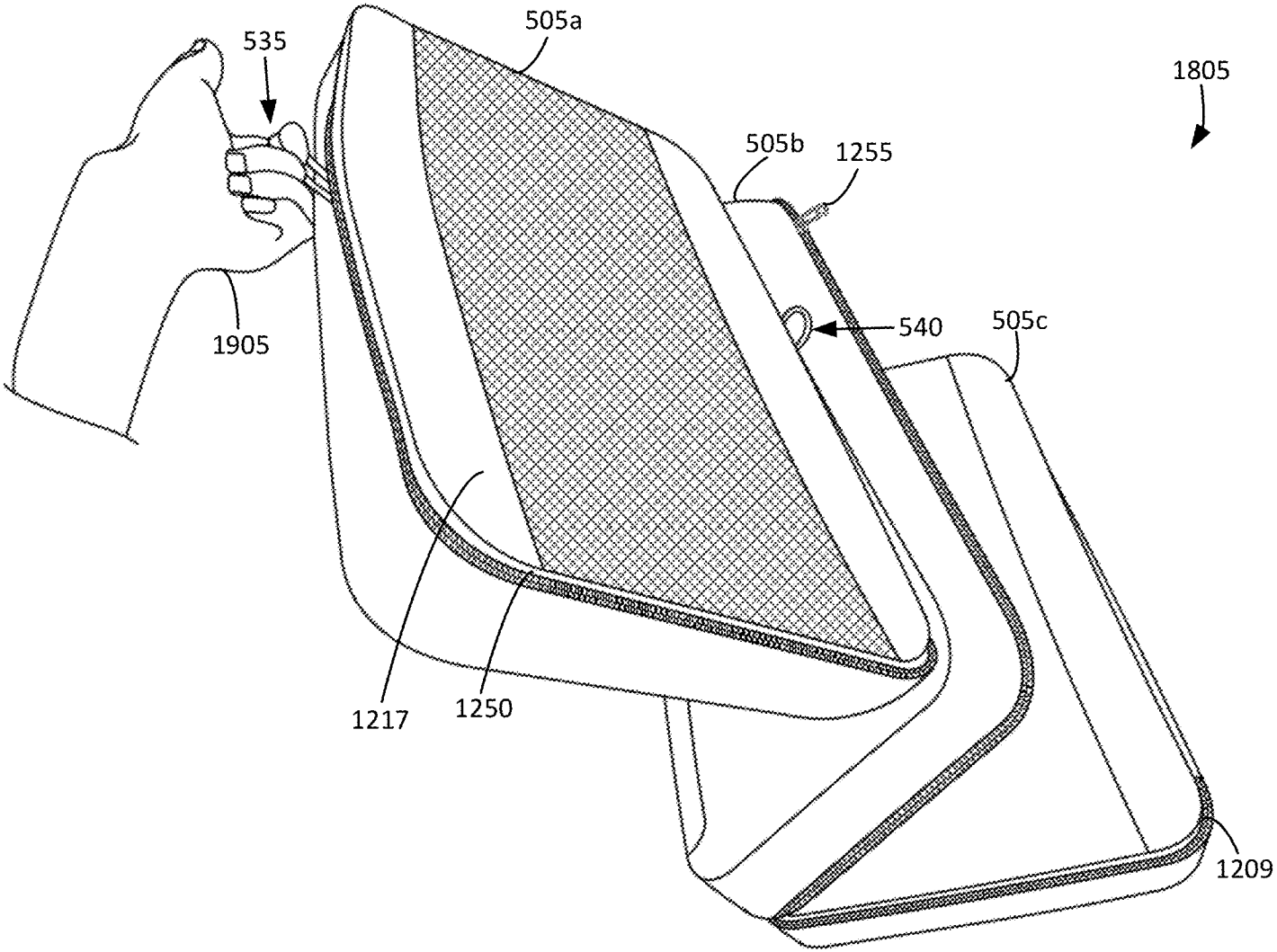
FIG. 20 illustrates the accessory organizer of FIG. 18 in a partially unfolded configuration with the human hand engaging with the first pull handle or strap.

FIG. 19 illustrates the accessory organizer 1805 of FIG. 18 in the folded configuration with a human hand 1905 engaging with a first pull handle or strap 535. Each of the compartments 505 can include a flexible material top wall (e.g., 1217). FIG. 20 illustrates the accessory organizer 1805 of FIG. 18 in a partially unfolded configuration with the human hand 1905 engaging with the first pull handle or strap 535. The collapsible compartments 505 can include a first collapsible compartment 505*a*, a second collapsible compartment 505*b*, and a third collapsible compartment 505*c*. It will be understood that while three collapsible compartments are shown, any suitable collapsible compartments can be made part of the accessory organizer without departing from the inventive concepts disclosed herein. The flexible material top wall 1217 of the first collapsible compartment 505*a* can be at least partially removably attached using a first zipper 1250 to at least three collapsible sidewalls from among the first, second, third, and fourth rigid collapsible sidewalls of the first collapsible compartment 505*a*. Similarly, this can be the case for the other collapsible compartments (e.g., 505*b* and 505*c*).

Figure 21:
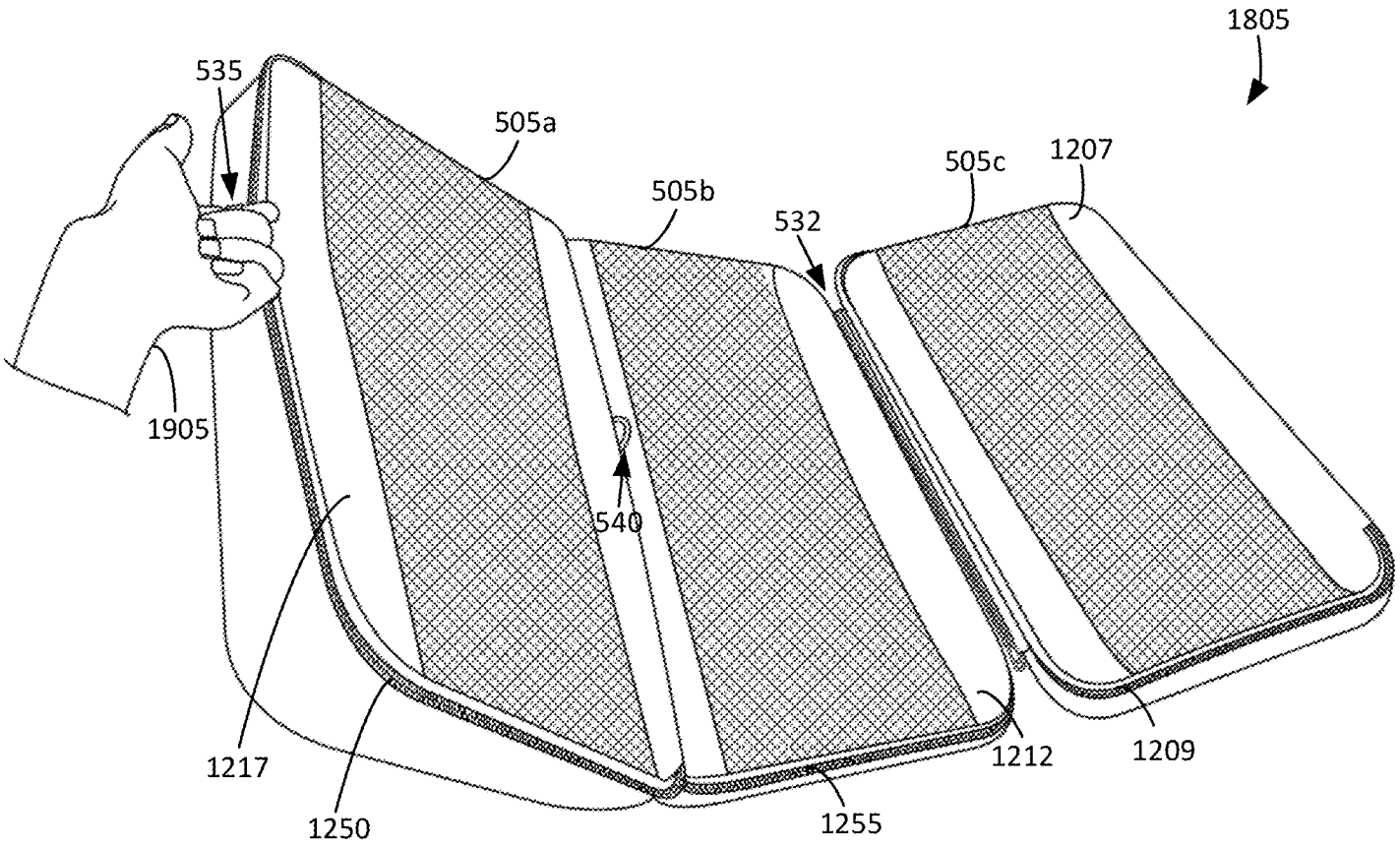
FIG. 21 illustrates the accessory organizer of FIG. 18 in another partially unfolded configuration with the human hand engaging with the first pull handle or strap.

For example, as shown in FIG. 21, the accessory organizer 1805 can be in another partially unfolded configuration with the human hand 1905 continuing to engage with the first pull handle or strap 535. The flexible material top wall 1212 of the second collapsible compartment 505*b* can be at least partially removably attached using a second zipper 1255 to at least three collapsible sidewalls from among the first, second, third, and fourth rigid collapsible sidewalls of the second collapsible compartment 505*b*. Similarly, the flexible material top wall 1207 of the third collapsible compartment 505*c* can be at least partially removably attached using a third zipper 1209 to at least three collapsible sidewalls from among the first, second, third, and fourth rigid collapsible sidewalls of the third collapsible compartment 505*c*. Also shown in FIG. 21 is a connector 532 located along a region of the flexible material top wall 1207 of the third collapsible compartment 505*c*. The connector 532 can include a zipper, a pile tape, a snap, a button, or the like.

Figure 22:
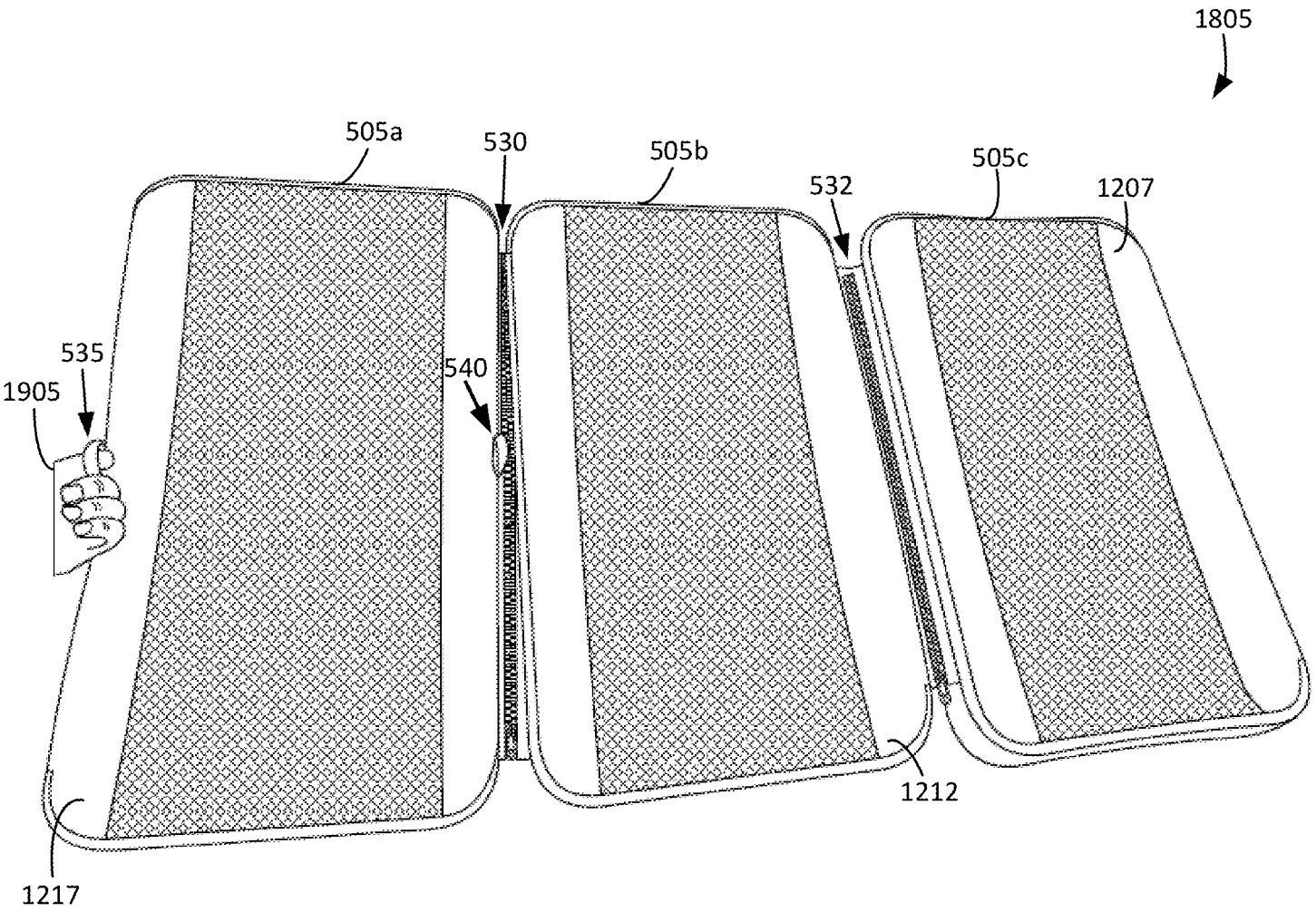
FIG. 22 illustrates the accessory organizer of FIG. 18 in a completely unfolded configuration with the human hand engaging with the first pull handle or strap.
Figure 23:
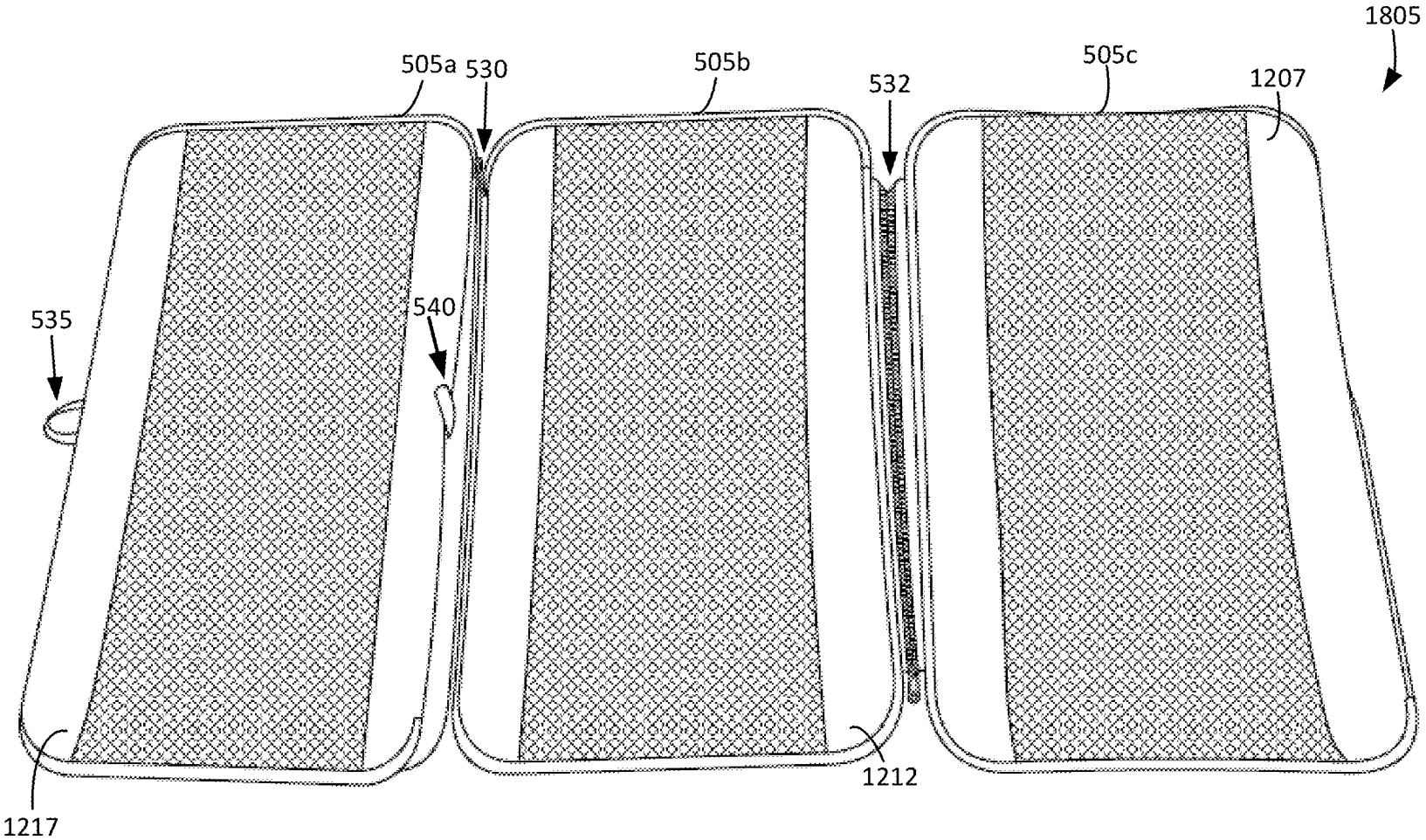
FIG. 23 illustrates the accessory organizer of FIG. 18 in the completely unfolded configuration.

FIG. 22 illustrates the accessory organizer 1805 of FIG. 18 in a completely unfolded configuration with the human hand 1905 still engaging with the first pull handle or strap 535. Some of the reference numerals are described above, and therefore, a detailed description for those is not necessarily repeated. Shown in FIG. 22 is a connector 530 that is located along a region of a flexible material bottom wall (not shown) of the first collapsible compartment 505*a*. The connector 530 can include a zipper, a pile tape, a snap, a button, or the like. FIG. 23 illustrates the accessory organizer 1805 of FIG. 18 in the completely unfolded standalone configuration with the human hand 1905 removed from the first pull handle or strap 535.

Figure 24:
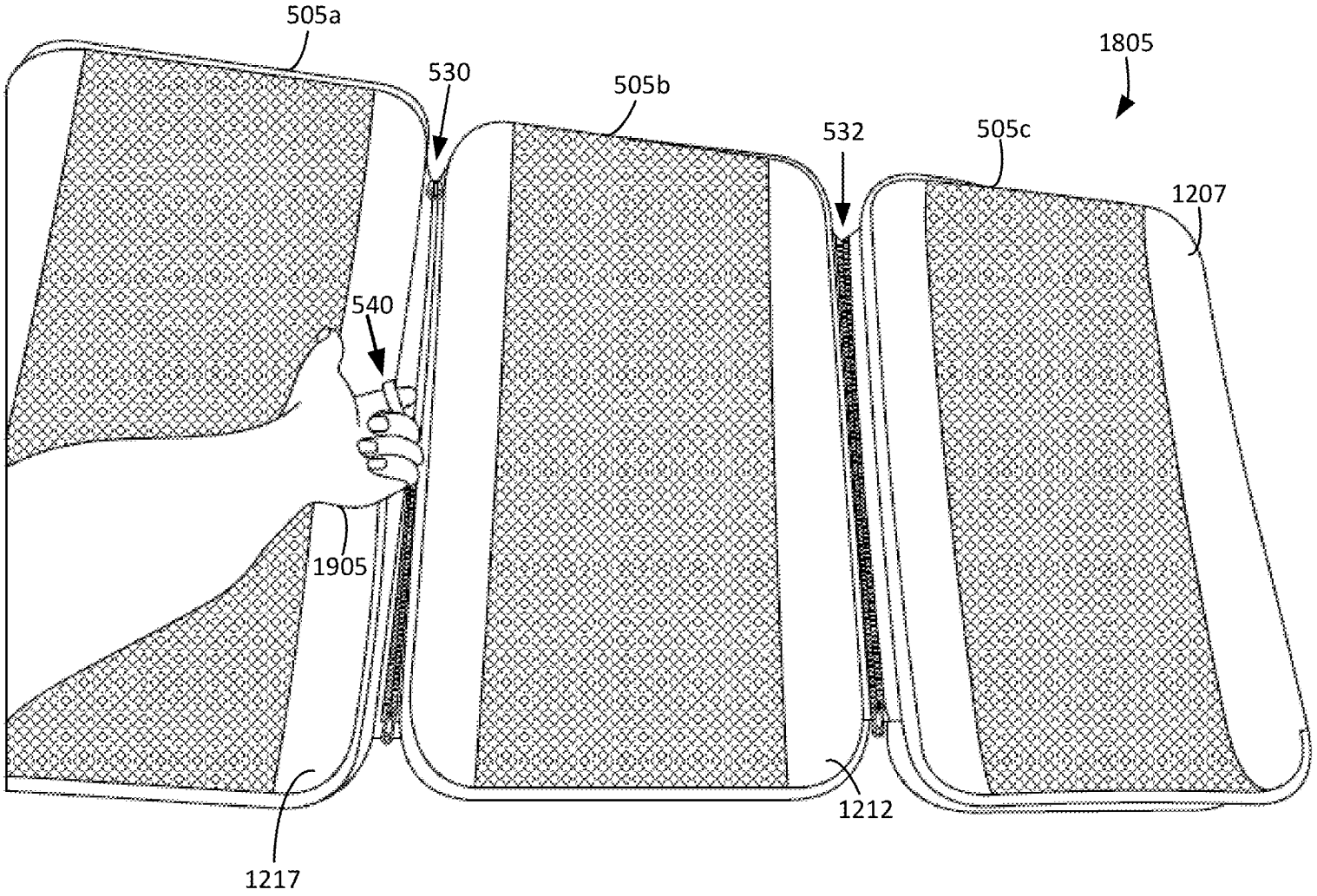
FIG. 24 illustrates the accessory organizer of FIG. 18 in the completely unfolded configuration with the human hand engaging with a second pull handle or strap.
Figure 25:
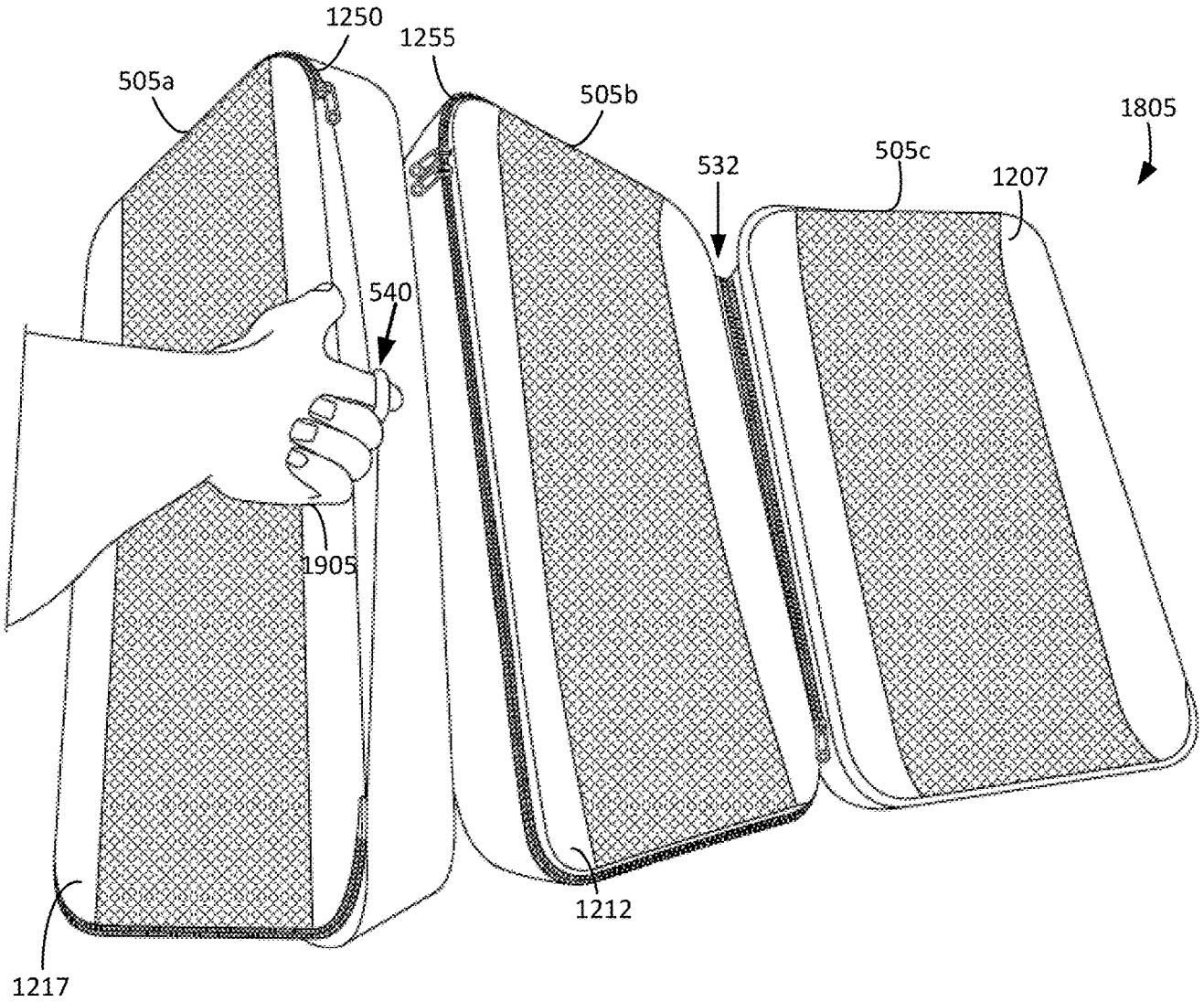
FIG. 25 illustrates the accessory organizer of FIG. 18 in a partially folded configuration with the human hand engaging with the second pull handle or strap.
Figure 26:
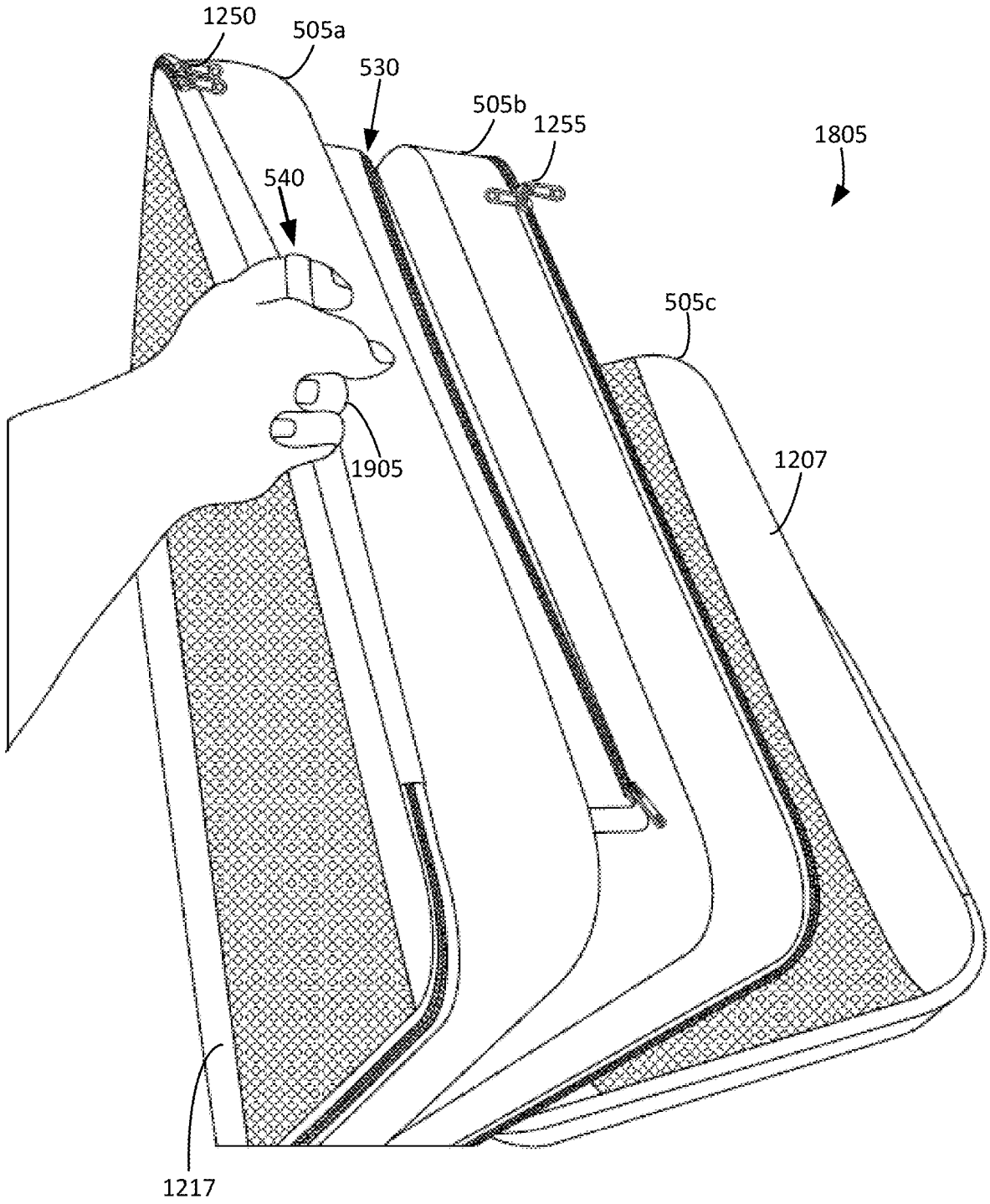
FIG. 26 illustrates the accessory organizer of FIG. 18 in another partially folded configuration with the human hand engaging with the second pull handle or strap.
Figure 27:
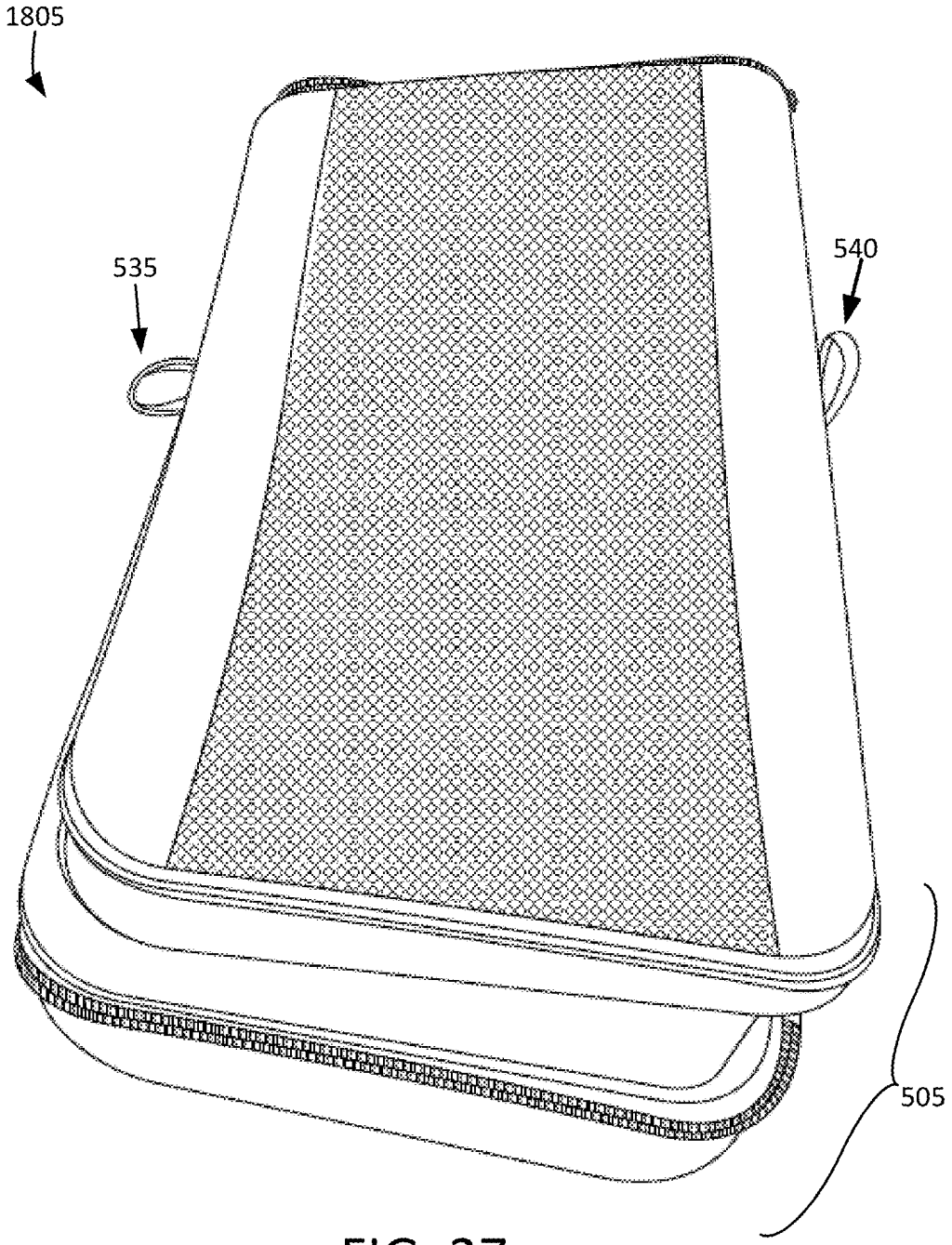
FIG. 27 illustrates the accessory organizer of FIG. 18 in a completely folded configuration.

FIG. 24 illustrates the accessory organizer 1805 of FIG. 18 in the completely unfolded configuration with the human hand 1905 engaging with a second pull handle or strap 540. Some of the reference numerals are described above, and therefore, a detailed description for those is not necessarily repeated. When the traveler has finished accessing one or more of the compartments 505, the traveler can then quickly and easily stack the compartments into a folded configuration by grasping the second pull handle or strap 540 and lifting. FIG. 25 illustrates the accessory organizer 1805 of FIG. 18 in a partially folded configuration with the human hand 1905 still engaging with the second pull handle or strap 540. FIG. 26 illustrates the accessory organizer 1805 of FIG. 18 in another partially folded configuration with the human hand engaging 1905 with the second pull handle or strap 540. The connector 530 can be seen, which connects the first collapsible compartment 505*a* to the second collapsible compartment 505*b*. FIG. 27 illustrates the accessory organizer 1805 of FIG. 18 back in the completely folded configuration.

Figure 28:
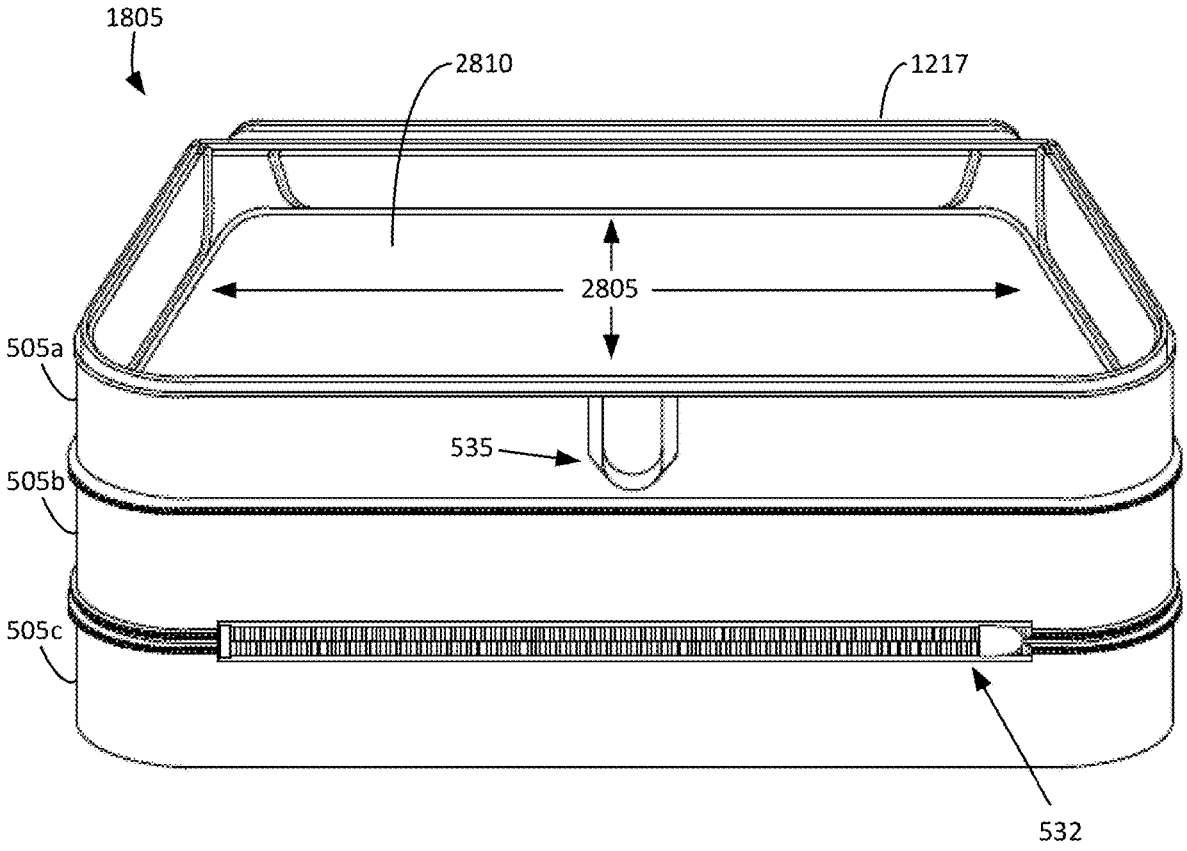
FIG. 28 illustrates an accessory organizer in a folded configuration with a top compartment in an open configuration in accordance with various inventive concepts of the present invention.
Figure 29:
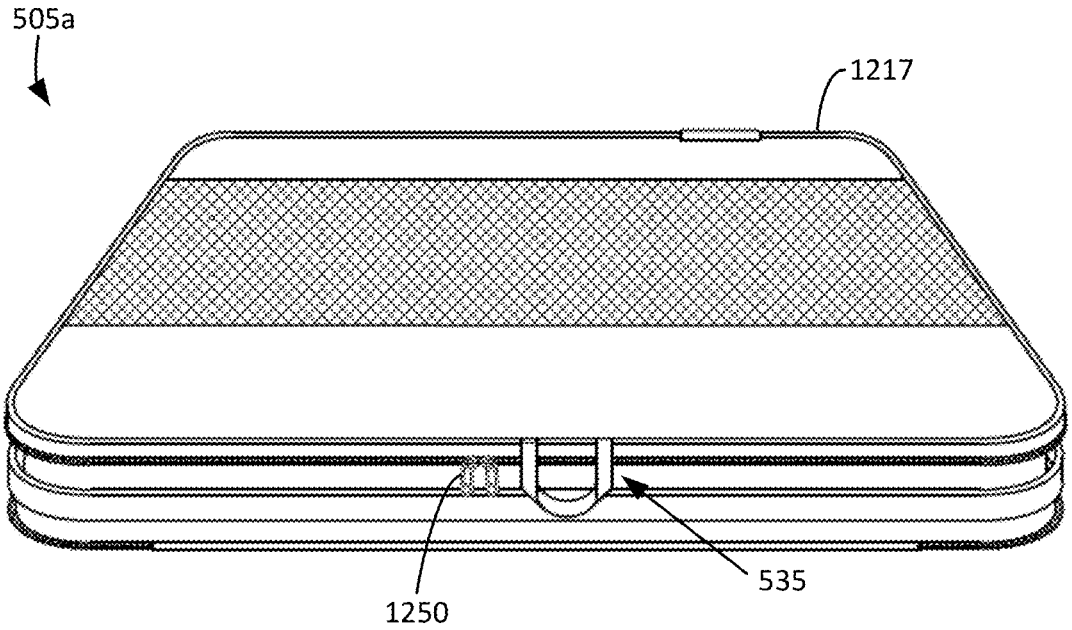
FIG. 29 illustrates a single compartment from the accessory organizer of FIG. 28 in a collapsed and closed configuration in accordance with various inventive concepts of the present invention.
Figure 30:
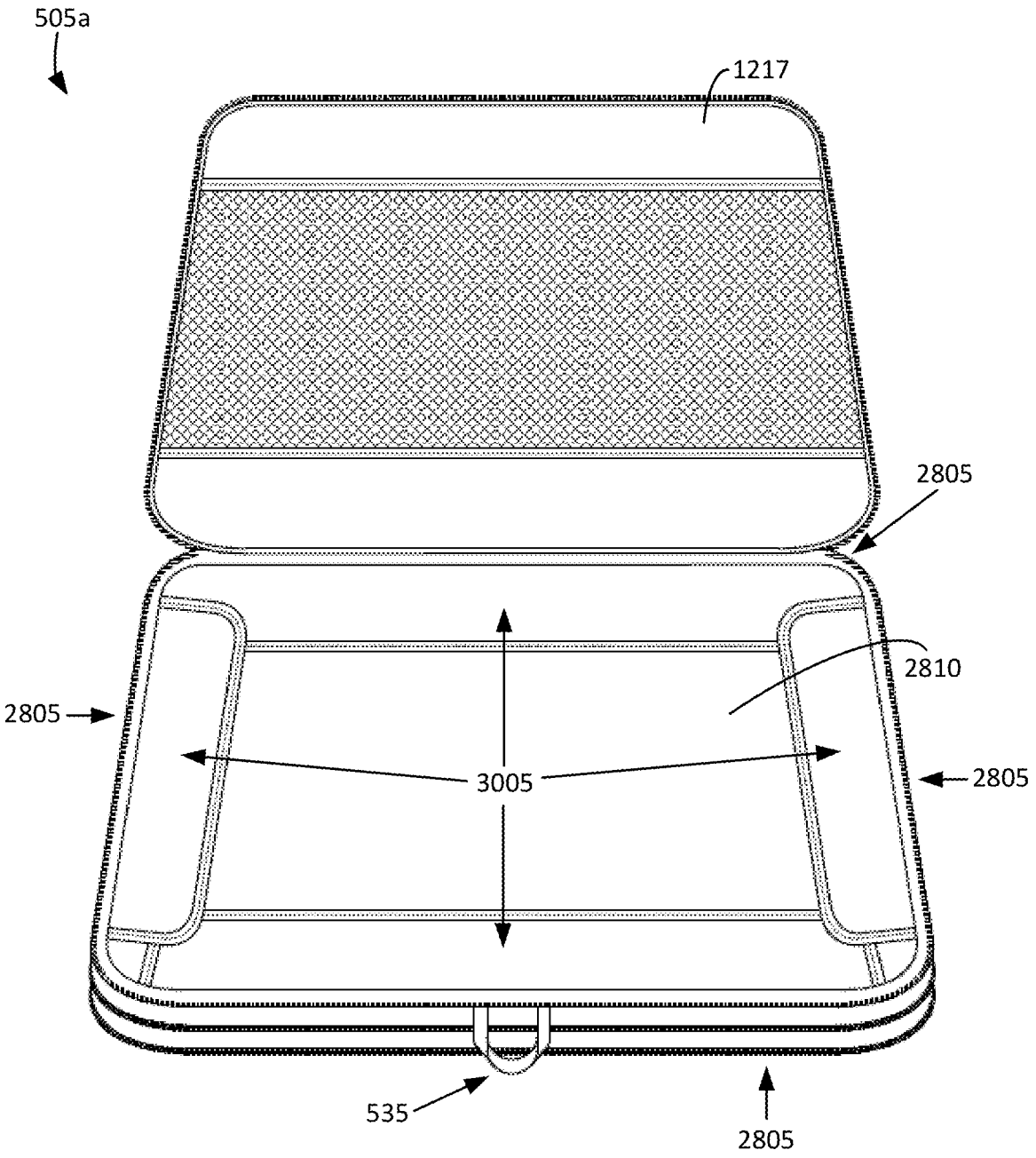
FIG. 30 illustrates a single compartment from the accessory organizer of FIG. 28 in a collapsed and open configuration in accordance with various inventive concepts of the present invention.

FIG. 28 illustrates an accessory organizer 1805 in a folded configuration with a top collapsible compartment 505*a* in an open and upright configuration in accordance with various inventive concepts of the present invention. The traveler can gain access to the personal belongings in the top collapsible compartment 505*a* by at least partially detaching the flexible material top wall 1217 from one or more of the rigid collapsible sidewalls 2805 of the top collapsible compartment 505*a*. Each of the compartments (e.g., 505*a*, 505*b*, 505*c*, etc.) can include a flexible material bottom wall (e.g., 2810). Some of the reference numerals are described above, and therefore, a detailed description for those is not necessarily repeated. FIG. 29 illustrates a single compartment 505*a* from the accessory organizer 1805 of FIG. 28 in a collapsed and closed configuration in accordance with various inventive concepts of the present invention. FIG. 30 illustrates the single compartment 505*a* from the accessory organizer 1805 of FIG. 28 in a collapsed and open configuration in accordance with various inventive concepts of the present invention.

The first, second, third, and fourth rigid collapsible sidewalls 2805 of the first collapsible compartment 505*a* can include first, second, third, and fourth internal rigid flaps 3005 that are configured in an upright orientation or a flat orientation. In the flat configuration, as shown in FIG. 30, the internal rigid flaps 3005 permit the compartment 505*a* to be collapsed into a relatively flat configuration. In this manner, the compartment 505*a* can each be collapsed down when necessary to free up interior volume of the luggage bag (e.g., 105 of FIG. 2) in which the accessory organizer 1805 may be placed. The compartment 505*a* can be collapsed down prior to being shipped from the manufacturer or supplier to the end customer, which reduces shipping cost because the total volume of the compartments (e.g., 505*a*) of the accessory organizer 1805 is significantly reduced. Each of the other compartments (e.g., 505*b*, 505*c*, etc.) can be collapsed in a similar manner, i.e., by changing the internal rigid flaps 3005 from an upright configuration to a flat configuration.

Figure 31:
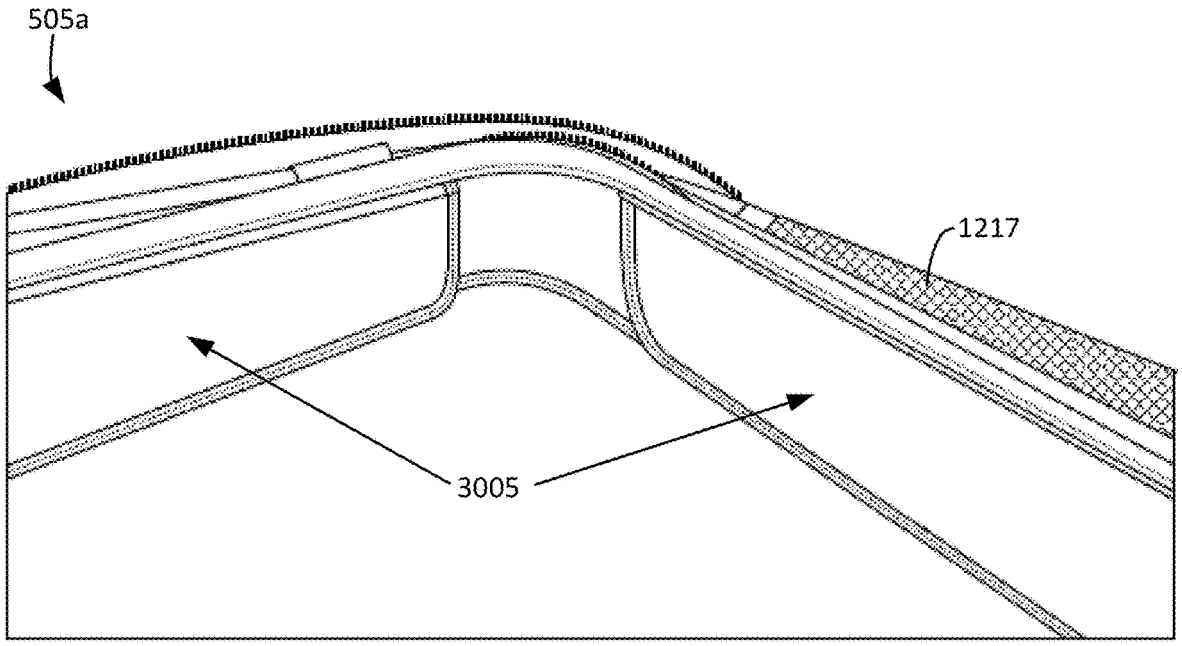
FIG. 31 illustrates a single compartment from the accessory organizer of FIG. 28 in a partially collapsed and open configuration in accordance with various inventive concepts of the present invention.
Figure 32:
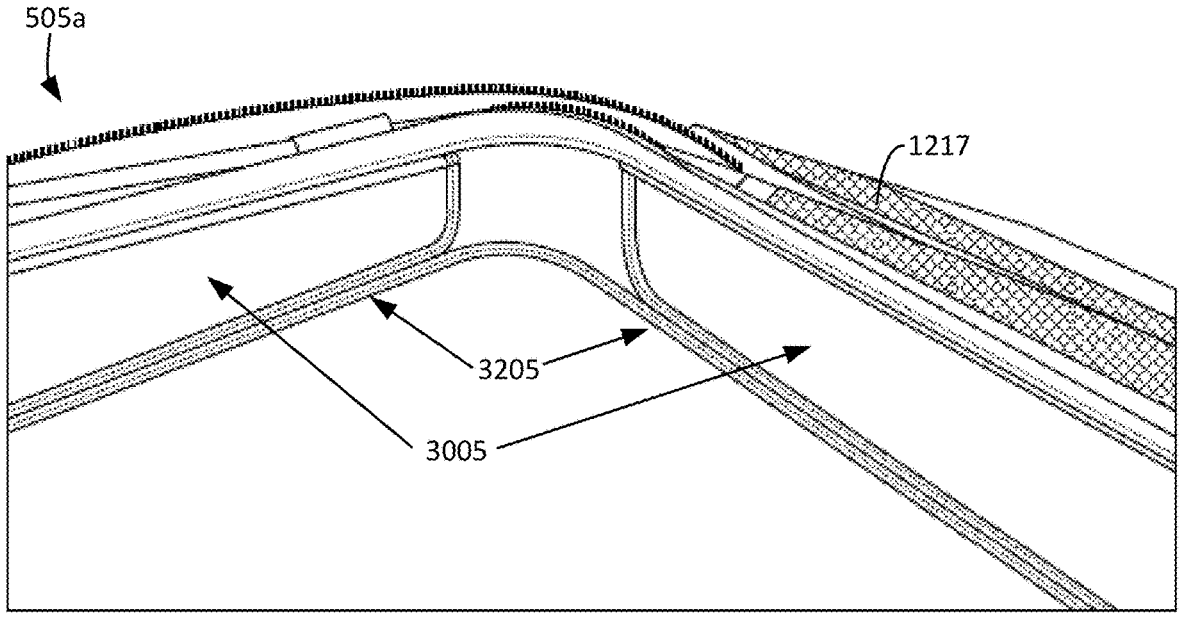
FIG. 32 illustrates a single compartment from the accessory organizer of FIG. 28 in an upright and open configuration in accordance with various inventive concepts of the present invention.

FIG. 31 illustrates a single compartment 505*a* from the accessory organizer 1805 of FIG. 28 in a partially collapsed and open configuration in accordance with various inventive concepts of the present invention. FIG. 32 illustrates a single compartment 505*a* from the accessory organizer 1805 of FIG. 28 in an upright and open configuration in accordance with various inventive concepts of the present invention. As can be seen, the flexible material top wall 1217 is in a detached and opened configuration. The traveler can change the configuration of the accessory organizer 1805 from the collapsed position to the upright position by standing the individual internal rigid flaps 3005 upright and tucking them behind a seam 3205 as shown in FIG. 32. Conversely, the traveler can change the configuration of the accessory organizer 1805 from the upright position to the collapsed position by untucking the individual internal rigid flaps 3005 from behind the seam 3205 as shown in FIG. 31.

Figure 33:
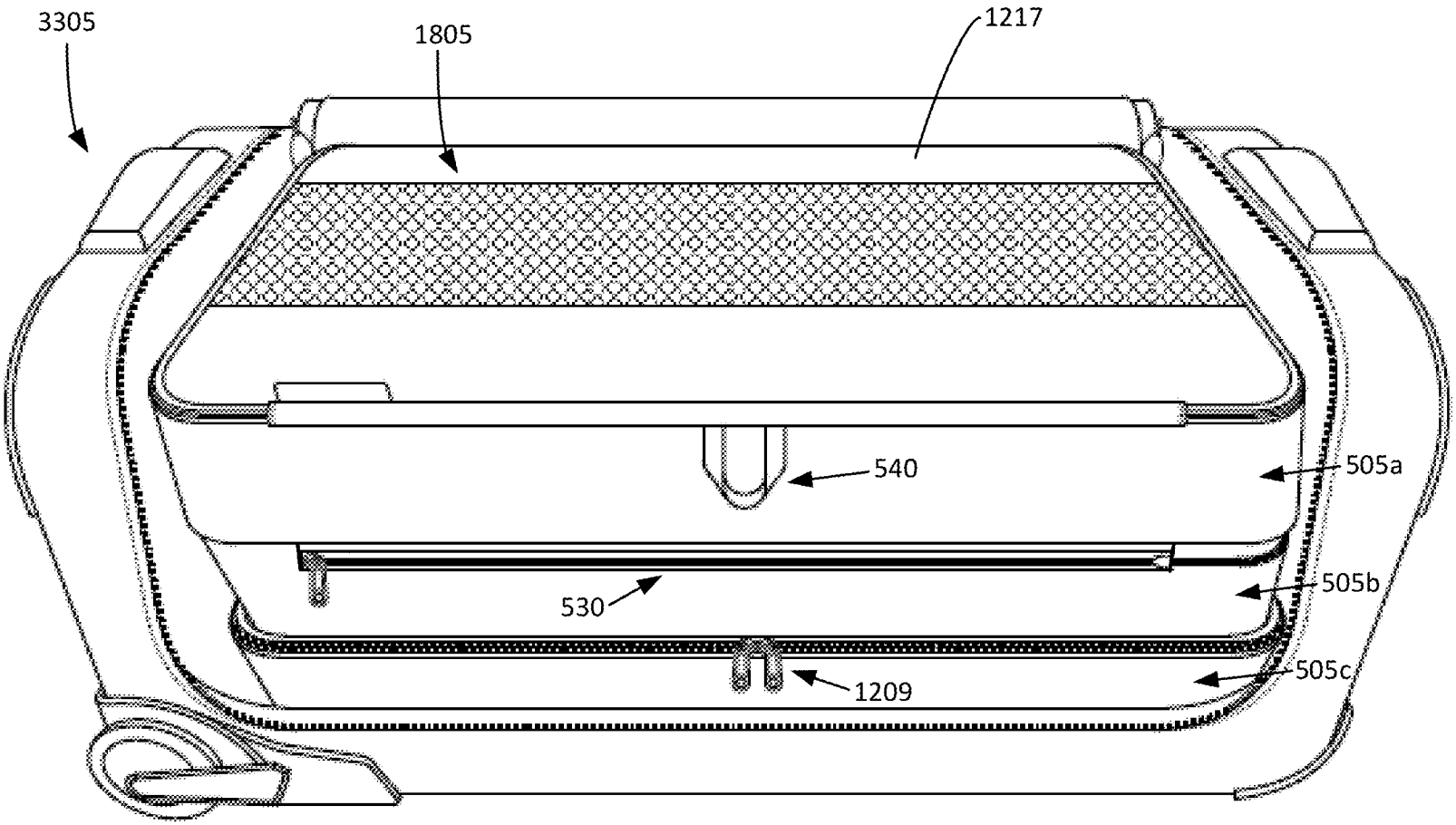
FIG. 33 illustrates the accessory organizer of FIG. 28 in an upright and closed configuration and located within a luggage bag in accordance with various inventive concepts of the present invention.

FIG. 33 illustrates the accessory organizer 1805 of FIG. 28 in an upright and closed configuration and located within a luggage bag 3305 in accordance with various inventive concepts of the present invention. Some elements shown in FIG. 17 are described in detail above, and therefore a detailed description of such elements is not necessarily repeated. One or more of the compartments (e.g., 505*a*, 505*b*, 505*c*) can be in a collapsed configuration.

For example, if the traveler is leaving on a trip and does not need to fill all three compartments, then one of the compartments (e.g., 505*a*) can be collapsed while the other two compartments (e.g., 505*b* and 505*c*) can be put in an upright configuration. This makes more room within the luggage bag 3305 for larger items. At any time during the trip, the traveler may decide that the compartment 505*a* needs to be occupied with new items, and therefore, the compartment 505*a* can be changed from the collapsed configuration to an upright configuration. In this manner, any number of compartments can be set in the collapsed configuration or the upright configuration depending on the needs of the traveler.

Figure 34:
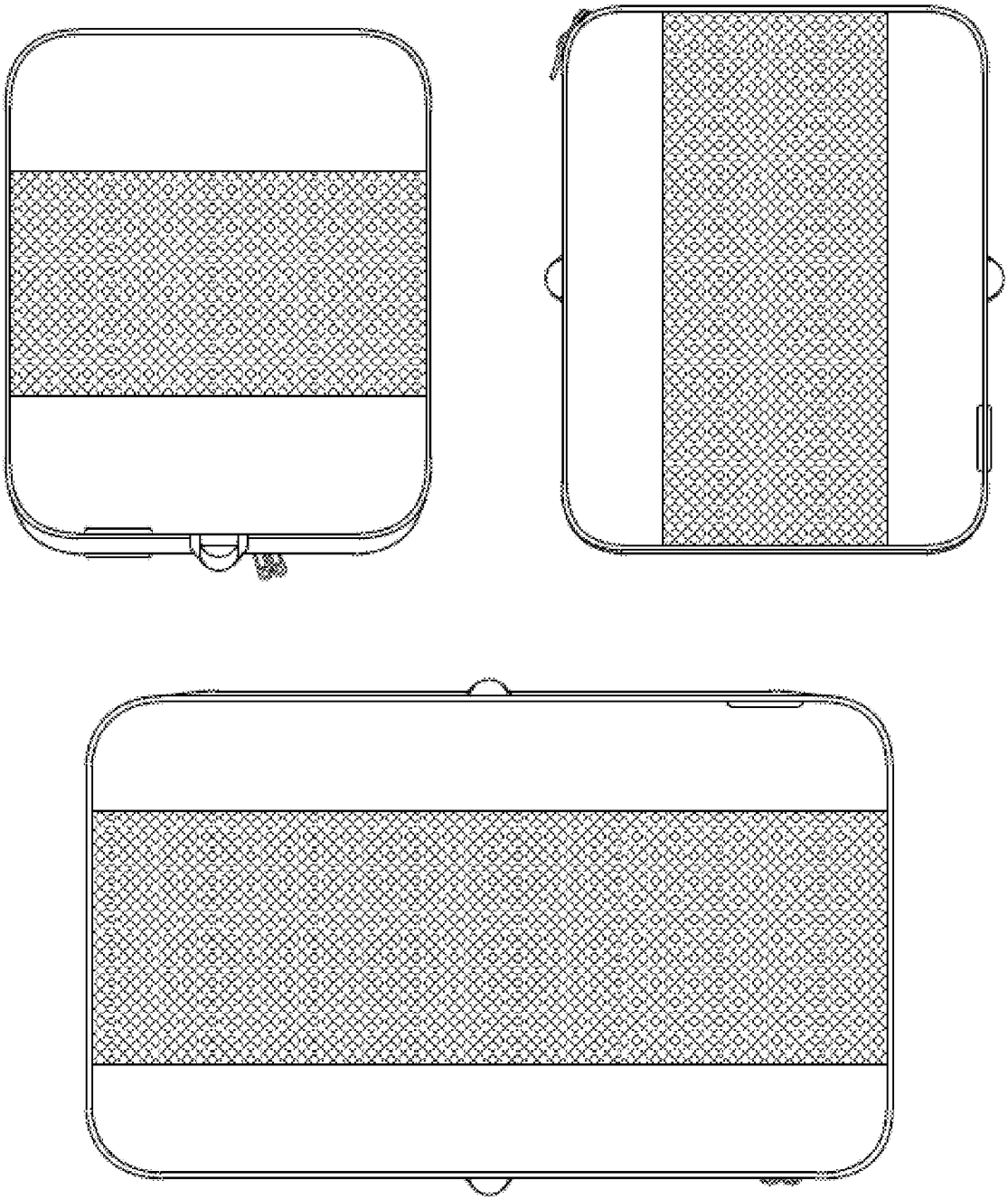
FIG. 34 illustrates a plan view of various different accessory organizers having various dimensions in accordance with various inventive concepts of the present invention.
Figure 35A:
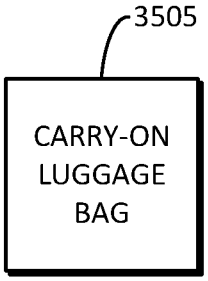
FIGS. 35A through 35G illustrate a carry-on luggage bag, a checked-in luggage bag, a rolling duffel luggage bag, a cosmetics kit, an electronics carrier, a tool kit, and a toiletry kit, respectively, in accordance with various inventive concepts of the present invention.
Figure 35B:
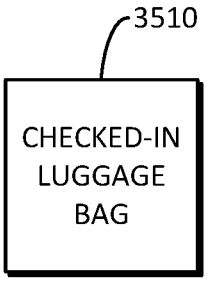
Figure 35C:
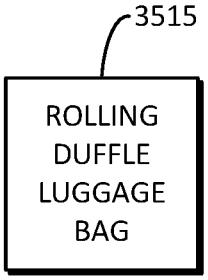
Figure 35D:
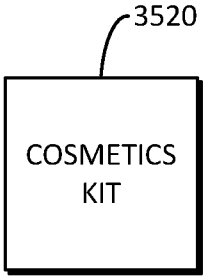
Figure 35E:
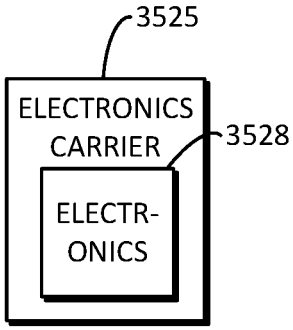
Figure 35F:
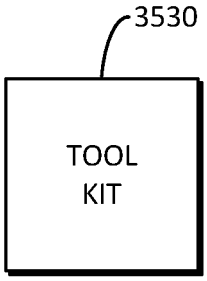
Figure 35G:
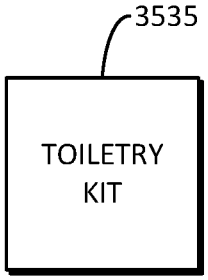

FIG. 34 illustrates a plan view of various different accessory organizers (e.g., 1805) having various dimensions in accordance with various inventive concepts of the present invention. FIGS. 35A through 35G illustrate a carry-on luggage bag 3505, a checked-in luggage bag 3510, a rolling duffel luggage bag 3515, a cosmetics kit 3520, an electronics carrier 3525, a tool kit 3530, and a toiletry kit 3535, respectively, in accordance with various inventive concepts of the present invention. Reference is now made to FIGS. 34 and 35A through 35G. For example, the dimensions of the first, second, and third collapsible compartments 505 of the accessory organizer 1805 can be such that they fit within a carry-on luggage bag 3505 that is 21 inches long, 16 inches wide, and 9 inches deep. Within the carry-on class of luggage bag 3505, the accessory organizer 1805 can be provided in small, medium, and large versions. In other words, multiple different accessory organizers (e.g., 1805) having different dimensions can be provided, so that travelers can select one or more of the different accessory organizers (e.g., 1805) to be placed within their carry-on luggage bag 3505.

By way of another example, the dimensions of the first, second, and third collapsible compartments 505 of the accessory organizer 1805 can be such that they fit within a larger checked-in luggage bag 3510 that is 30 inches long, 20 inches wide, and 10 inches deep. Within the checked-in class of luggage bag 3510, the accessory organizer 1805 can be provided in small, medium, and large versions. In other words, multiple different accessory organizers (e.g., 1805) having different dimensions can be provided, so that travelers can select one or more of the different accessory organizers (e.g., 1805) to be placed within their checked-in luggage bag 3510.

By way of yet another example, the dimensions of the first, second, and third collapsible compartments 505 of the accessory organizer 1805 can be such that they fit within a rolling duffel luggage bag 3515 that is 24 inches long, 14 inches wide, and 10 inches deep. Within the rolling duffel bag class of luggage bag 3515, the accessory organizer 1805 can be provided in small, medium, and large versions. In other words, multiple different accessory organizers (e.g., 1805) having different dimensions can be provided, so that travelers can select one or more of the different accessory organizers (e.g., 1805) to be placed within their rolling duffel luggage bag 3515.

By way of still another example, the dimensions of the first, second, and third collapsible compartments 505 of the accessory organizer 1805 can be quite small, such that they accommodate a toiletry kit 3535, for example. By way of another example, the dimensions of the first, second, and third collapsible compartments 505 of the accessory organizer 1805 can be sized to accommodate a cosmetics kit 3520. By way of yet another example, the dimensions of the first, second, and third collapsible compartments 505 of the accessory organizer 1805 can be sized to accommodate an electronics carrier 3525 to carry electronics 3528 such as a smart phone, charging cables, tablet, or the like. By way of still another example, the dimensions of the first, second, and third collapsible compartments 505 of the accessory organizer 1805 can be sized to accommodate a tool kit 3530 to carry tools such as screw drivers, pliers, hammers, nails, screws, or the like. It will be understood that the accessory organizer 1805 can have any suitable dimensions.

Moreover, multiple modular collapsible accessory organizers (e.g., 1805) having various dimensions can be stored in a single luggage bag (e.g., 3305 of FIG. 33). In other words, different modular collapsible accessory organizers (e.g., 1805) can be mixed and matched in an adaptable and flexible manner such that a traveler's belongings are well-organized in and easily accessible from the luggage bag (e.g., 3305 of FIG. 33).

Referring now to FIGS. 18 through 34, a modular collapsible accessory organizer 1805 for use with a luggage bag 3305 can include first, second, and third collapsible compartments 505*a*, 505*b*, and 505*c* each including first, second, third, and fourth rigid collapsible sidewalls 2805, a flexible material top wall (e.g., 1217), and a flexible material bottom wall 2810. The modular collapsible accessory organizer 1805 can include a first connector located 530 along one region of the flexible material bottom wall 2810 of the first collapsible compartment 505*a*. The modular collapsible accessory organizer 1805 can include a second connector 532 located along another region of the flexible material top wall 1207 of the third collapsible compartment 505*c*. The modular collapsible accessory organizer 1805 can include a first pull handle or strap 535 connected to the first collapsible compartment 505*a*. The modular collapsible accessory organizer 1805 can include a second pull handle or strap 540 connected to the first collapsible compartment 505*a*.

The first connector 530 connects the first collapsible compartment 505*a* to the second collapsible compartment 505*b* such that the first connector 530 connects the flexible material bottom wall (e.g., 2810) of the first collapsible compartment 505*a* to the flexible material bottom wall (e.g., 2810) of the second collapsible compartment 505*b*. The second connector 532 connects the third collapsible compartment 505*c* to the second collapsible compartment 505*b* such that the second connector 532 connects the flexible material top wall 1207 of the third collapsible compartment 505*c* to the flexible material top wall 1212 of the second collapsible compartment 505*b*. The first pull handle or strap 535 is configured to unfold and deploy the first, second, and third collapsible compartments 505*a*, 505*b*, and 505*c*, respectively. The second pull handle or strap 540 is configured to fold the first, second, and third collapsible compartments 505*a*, 505*b*, and 505*c*, respectively, one atop the other. The first, second, and third collapsible compartments 505*a*, 505*b*, and 505*c*, respectively, are configured to unfold one from another when the traveler lifts on the second pull handle or strap 540.

The first, second, and third collapsible compartments 505*a*, 505*b*, and 505*c* of the accessory organizer 1805 are entirely insertable into and removable out from the luggage bag 3305. The flexible material top wall 1217 of the first collapsible compartment 505*a* is at least partially removably attached to one or more other rigid collapsible sidewalls (e.g., 2805) from among the first, second, third, and fourth rigid collapsible sidewalls (e.g., 2805) of the first collapsible compartment 505*a*. The flexible material bottom wall (e.g., 2810) and the first, second, third, and fourth rigid collapsible sidewalls (e.g., 2805) of the first compartment 505*a* can be substantially opaque. The first, second, third, and fourth rigid collapsible sidewalls (e.g., 2805) of the second collapsible compartment 505*b* are separate and spaced apart from the first and third collapsible compartments 505*a* and 505*c*, respectively. The flexible material top wall 1212 of the second collapsible compartment 505*b* is at least partially removably attached to one or more other rigid collapsible sidewalls from among the first, second, third, and fourth rigid collapsible sidewalls (e.g., 2805) of the second collapsible compartment 505*b*. The flexible material bottom wall (e.g., 2810) and the first, second, third, and fourth rigid collapsible sidewalls (e.g., 2805) of the second compartment 505*b* can be substantially opaque. The first, second, third, and fourth rigid collapsible sidewalls (e.g., 2805) of the third collapsible compartment 505*c* are separate and spaced apart from the first and second collapsible compartments 505*a* and 505*b*, respectively.

In some embodiments, the flexible material top wall 1207 of the third collapsible compartment 505*c* is at least partially removably attached to one or more other rigid collapsible sidewalls from among the first, second, third, and fourth rigid collapsible sidewalls (e.g., 2805) of the third collapsible compartment 505*c*. The flexible material bottom wall (e.g., 2810) and the first, second, third, and fourth rigid collapsible sidewalls (e.g., 2805) of the third compartment 505*c* can be substantially opaque.

In some embodiments, the first pull handle or strap 535 is connected at an end of the accessory organizer in a first region including the flexible material top wall 1217 and the first rigid collapsible sidewall (e.g., 2805) of the first collapsible compartment 505*a*. The second pull handle or strap 540 can be connected in a second region including the flexible material top wall 1217 and the second rigid collapsible sidewall (e.g., 2805) opposite the first rigid collapsible sidewall (e.g., 2805) of the first collapsible compartment 505*a*.

In some embodiments, the second pull handle or strap 540 is disposed between the first collapsible compartment 505*a* and the second collapsible compartment 505*b*. In some embodiments, the second pull handle or strap 540 is disposed directly opposite the first connector 530 relative to the second rigid collapsible sidewall (e.g., 2805) of the first collapsible compartment 505*a*.

The second pull handle or strap 540 is configured to be lifted such that the first collapsible compartment 505*a* is configured to be folded on the second collapsible compartment 505*b*, and the second collapsible compartment 505*b* is configured to be folded on the third collapsible compartment 505*c*, in a folded configuration. In the folded configuration, the first and third collapsible compartments 505*a* and 505*c*, respectively, are in an upright orientation, and the second collapsible compartment 505*b* is in an inverted orientation.

In some embodiments, the first, second, third, and fourth rigid collapsible sidewalls (e.g., 2805) of the first collapsible compartment 505*a* includes first, second, third, and fourth internal rigid flaps 3005 that can be configured in at least one of an upright orientation or a flat orientation. The first, second, third, and fourth rigid collapsible sidewalls (e.g., 2805) of the second collapsible compartment 505*b* includes first, second, third, and fourth internal rigid flaps (e.g., 3305) that can be configured in at least one of an upright orientation or a flat orientation. The first, second, third, and fourth rigid collapsible sidewalls (e.g., 2805) of the third collapsible compartment 505*c* includes first, second, third, and fourth internal rigid flaps (e.g., 3305) that can be configured in at least one of an upright orientation or a flat orientation.

Having described and illustrated the principles of the invention with reference to illustrated embodiments, it will be recognized that the illustrated embodiments can be modified in arrangement and detail without departing from such principles, and can be combined in any desired manner. And although the foregoing discussion has focused on particular embodiments, other configurations are contemplated. In particular, even though expressions such as "according to an embodiment of the invention" or the like are used herein, these phrases are meant to generally reference embodiment possibilities, and are not intended to limit the invention to particular embodiment configurations. As used herein, these terms can reference the same or different embodiments that are combinable into other embodiments.

Consequently, in view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

The invention claimed is:

1. An accessory organizer for use with a luggage bag, the accessory organizer comprising:

first, second, and third compartments;

a first connector located along one region of a bottom wall of the first compartment;

a second connector located along another region of a top wall of the third compartment;

a first pull handle or strap connected to the first compartment; and a second pull handle or strap connected to the first compartment, wherein the first connector connects the first compartment to the second compartment such that the first connector connects adjacent bottom walls of the first and second compartments, wherein the second connector connects the third compartment to the second compartment such that the second connector connects adjacent top walls of the third and second compartments, wherein the first pull handle or strap is configured to unfold and deploy the first, second, and third compartments, wherein the second pull handle or strap is configured to fold the first, second, and third compartments one atop the other, and wherein the first, second, and third compartments are configured to unfold one from another.

2. The accessory organizer of claim 1, wherein the first, second, and third compartments of the accessory organizer are entirely insertable into and removable out from a luggage bag.

3. The accessory organizer of claim 1, wherein:

the first compartment includes first, second, third, and fourth sidewalls, and a top wall that is at least partially removably attached to one or more other walls of the first compartment;

the bottom wall and the first, second, third, and fourth sidewalls of the first compartment are substantially opaque;

the second compartment includes first, second, third, and fourth sidewalls, that are separate and spaced apart from the first and third compartments;

the top wall of the second compartment is at least partially removably attached to one or more other walls of the second compartment;

the bottom wall and the first, second, third, and fourth sidewalls of the second compartment are substantially opaque;

the third compartment includes first, second, third, and fourth sidewalls that are separate and spaced apart from the first and second compartments;

the top wall of the third compartment is at least partially removably attached to one or more other walls of the third compartment; and the bottom wall and the first, second, third, and fourth sidewalls of the third compartment are substantially opaque.

4. The accessory organizer of claim 1, wherein:

the first pull handle or strap is connected at an end of the accessory organizer in a first region including a top wall and a first sidewall of the first compartment, and the second pull handle or strap is connected in a second region including the top wall and a second sidewall opposite the first sidewall of the first compartment.

5. The accessory organizer of claim 4, wherein:

the second pull handle or strap is disposed between the first compartment and the second compartment, and the second pull handle is disposed directly opposite the first connector relative to the second sidewall of the first compartment.

6. The accessory organizer of claim 5, wherein:

the second pull handle or strap is configured to be lifted such that the first compartment is configured to be folded on the second compartment, and the second compartment is configured to be folded on the third compartment, in a folded configuration, and in the folded configuration, the first and third compartments are in an upright orientation, and the second compartment is in an inverted orientation.

7. The accessory organizer of claim 1, wherein:

the first connector includes a first zipper, and the second connector includes a second zipper.

8. A modular collapsible accessory organizer for use with a luggage bag, the accessory organizer comprising:

first, second, and third collapsible compartments each including first, second, third, and fourth rigid collapsible sidewalls, a flexible material top wall, and a flexible material bottom wall;

a first connector located along one region of the flexible material bottom wall of the first collapsible compartment;

a second connector located along another region of the flexible material top wall of the third collapsible compartment;

a first pull handle or strap connected to the first collapsible compartment; and a second pull handle or strap connected to the first collapsible compartment, wherein the first connector connects the first collapsible compartment to the second collapsible compartment such that the first connector connects the flexible material bottom wall of the first collapsible compartment to the flexible material bottom wall of the second collapsible compartment, wherein the second connector connects the third collapsible compartment to the second collapsible compartment such that the second connector connects the flexible material top wall of the third collapsible compartment to the flexible material top wall of the second collapsible compartment, wherein the first pull handle or strap is configured to unfold and deploy the first, second, and third collapsible compartments, wherein the second pull handle or strap is configured to fold the first, second, and third collapsible compartments one atop the other, wherein the first, second, and third collapsible compartments are configured to unfold one from another, wherein the first, second, third, and fourth rigid collapsible sidewalls includes first, second, third, and fourth internal rigid flaps that are tucked behind a seam of the flexible material bottom wall in an upright orientation, and wherein the first, second, third, and fourth internal rigid flaps are untucked from the seam of the flexible material bottom wall in a flat orientation.

9. The modular collapsible accessory organizer of claim 8, wherein the first, second, and third collapsible compartments of the accessory organizer are entirely insertable into and removable out from a luggage bag.

10. The modular collapsible accessory organizer of claim 8, wherein:

the flexible material top wall of the first collapsible compartment is at least partially removably attached to one or more other rigid collapsible sidewalls from among the first, second, third, and fourth rigid collapsible sidewalls of the first collapsible compartment;

the flexible material bottom wall and the first, second, third, and fourth rigid collapsible sidewalls of the first compartment are substantially opaque;

the first, second, third, and fourth rigid collapsible sidewalls of the second collapsible compartment are separate and spaced apart from the first and third collapsible compartments;

the flexible material top wall of the second collapsible compartment is at least partially removably attached to one or more other rigid collapsible sidewalls from among the first, second, third, and fourth rigid collapsible sidewalls of the second collapsible compartment;

the flexible material bottom wall and the first, second, third, and fourth rigid collapsible sidewalls of the second compartment are substantially opaque;

the first, second, third, and fourth rigid collapsible sidewalls of the third collapsible compartment are separate and spaced apart from the first and second collapsible compartments;

the flexible material top wall of the third collapsible compartment is at least partially removably attached to one or more other rigid collapsible sidewalls from among the first, second, third, and fourth rigid collapsible sidewalls of the third collapsible compartment; and the flexible material bottom wall and the first, second, third, and fourth rigid collapsible sidewalls of the third compartment are substantially opaque.

11. The modular collapsible accessory organizer of claim 8, wherein:

the flexible material top wall of the first collapsible compartment is at least partially removably attached using a first zipper to at least three collapsible sidewalls from among the first, second, third, and fourth rigid collapsible sidewalls of the first collapsible compartment;

the flexible material top wall of the second collapsible compartment is at least partially removably attached using a second zipper to at least three collapsible sidewalls from among the first, second, third, and fourth rigid collapsible sidewalls of the second collapsible compartment; and the flexible material top wall of the third collapsible compartment is at least partially removably attached using a third zipper to at least three collapsible sidewalls from among the first, second, third, and fourth rigid collapsible sidewalls of the third collapsible compartment.

12. The modular collapsible accessory organizer of claim 8, wherein:

the first pull handle or strap is connected at an end of the accessory organizer in a first region including the flexible material top wall and the first rigid collapsible sidewall of the first collapsible compartment, and the second pull handle or strap is connected in a second region including the flexible material top wall and the second rigid collapsible sidewall opposite the first rigid collapsible sidewall of the first collapsible compartment.

13. The modular collapsible accessory organizer of claim 12, wherein:

the second pull handle or strap is disposed between the first collapsible compartment and the second collapsible compartment, and the second pull handle or strap is disposed directly opposite the first connector relative to the second rigid collapsible sidewall of the first collapsible compartment.

14. The modular collapsible accessory organizer of claim 13, wherein:

the second pull handle or strap is configured to be lifted such that the first collapsible compartment is configured to be folded on the second collapsible compartment, and the second collapsible compartment is configured to be folded on the third collapsible compartment, in a folded configuration, and in the folded configuration, the first and third collapsible compartments are in an upright orientation, and the second collapsible compartment is in an inverted orientation.

15. The modular collapsible accessory organizer of claim 8, wherein:

the first connector includes at least one of a first zipper, a first pile tape, a first snap, or a first button, and the second connector includes at least one of a second zipper, a second pile tape, a second snap, or a second button.

16. The modular collapsible accessory organizer of claim 8, wherein:

the first, second, third, and fourth rigid collapsible sidewalls of the first collapsible compartment includes the first, second, third, and fourth internal rigid flaps that are configured in at least one of the upright orientation or the flat orientation;

the first, second, third, and fourth rigid collapsible sidewalls of the second collapsible compartment includes the first, second, third, and fourth internal rigid flaps that are configured in at least one of the upright orientation or the flat orientation; and the first, second, third, and fourth rigid collapsible sidewalls of the third collapsible compartment includes the first, second, third, and fourth internal rigid flaps that are configured in at least one of the upright orientation or the flat orientation.

17. The modular collapsible accessory organizer of claim 8, wherein dimensions of the first, second, and third collapsible compartments are such that they fit within a carry-on luggage bag.

18. The modular collapsible accessory organizer of claim 8, wherein dimensions of the first, second, and third collapsible compartments are such that they fit within a checked-in luggage bag.

19. The modular collapsible accessory organizer of claim 8, wherein dimensions of the first, second, and third collapsible compartments are such that they fit within a rolling duffel luggage bag.

20. The modular collapsible accessory organizer of claim 8, wherein the first, second, and third collapsible compartments accommodate at least one of a) a toiletry kit, b) a cosmetics kit, c) electronics, or d) a tool kit.

* * * * *